United States Patent [19]

Seale et al.

[11] 4,201,386

[45] May 6, 1980

[54] GENEALOGY APPARATUS

[75] Inventors: Glenn C. Seale; George L. Frame, both of Albany, N.Y.

[73] Assignee: Triad Associates, Albany, N.Y.

[21] Appl. No.: 877,519

[22] Filed: Feb. 13, 1978

[51] Int. Cl.[2] ..... A63F 3/00

[52] U.S. Cl. ..... 273/236; 273/282; 273/288

[58] Field of Search ..... 273/236, 288; 40/19.5; 35/9 R, 21; 283/1 A

[56] References Cited

U.S. PATENT DOCUMENTS

| | | | |
|---|---|---|---|
| 699,799 | 5/1902 | Guild | 283/1 A |
| 2,757,934 | 8/1956 | Dunbar | 273/288 |
| 3,970,313 | 7/1976 | Montemayor | 273/243 |

FOREIGN PATENT DOCUMENTS

| | | | |
|---|---|---|---|
| 1138252 | 12/1968 | United Kingdom | 35/9 R |

*Primary Examiner*—Richard C. Pinkham
*Assistant Examiner*—R. Carl Moy
*Attorney, Agent, or Firm*—Quaintance, Murphy, & Richardson

[57] ABSTRACT

An apparatus for constructing the genealogies of famous and/or noble individuals is disclosed. The device consists of a board or pedigree surface and a series of 63 prism-like structures—one for the subject and one for each of his (her) 62 ancestors over the preceding five generations.

Each of these prism-like structures contains nominal information on a particular individual as well as a short biographical sketch or anecdote. Included in the sketch or anecdote is that individual's relationship to one or more members of the family tree. These familial relationships enable users to correctly place ancestors with the aid of certain known points within the pedigree.

These known points are board positions which are labeled with the same nominal information as found on the prism-like structures. The great majority of board positions, however, are unlabeled and the proper ancestor for each of these sites must be deduced from familial relationships contained in the biographical sketches.

The apparatus contains an instruction set which describes the manner of use. Included in these instructions are various diagrams which interrelate the geometry of pedigree construction and the various familial relationships described above.

10 Claims, 32 Drawing Figures

GENEALOGY APPARATUS

BACKGROUND OF THE INVENTION

1. Field of the Invention

This invention relates to a genealogical apparatus. More particularly, this invention relates to a genealogical apparatus in which the pedigree of an individual is constructed upon a game board utilizing insertable playing pieces.

2. General Considerations and Prior Art

Genealogy is an interesting hobby engaged in by numerous people. The genealogy of any person can be fascinating in that it relates a particular person to events in history. The genealogy of famous people is something that a large number of people find fascinating. By studying the genealogy of famous people an understanding and appreciation of history is nurtured. In order to make the study of genealogy even more interesting and pleasurable a game-type format is desirable wherein one or more people can participate in constructing a family tree.

U.S. Pat. Nos. 1,058,859 and 3,970,313 are exemplary of prior art genealogical games and apparatus, however, these devices have a structural configuration and method of use quite different from the genealogical apparatus of the instant invention.

U.S. Pat. Nos. 1,540,324; 2,150,850 and 2,513,219 each show game apparatus in which game boards are designed to receive cards having various types of information thereon. These game boards are not designed in a fashion to enhance the visibility of information displayed on the cards and therefore are not particularly suitable for a game playing board which contains a large amount of relatively crowded information, all of which must be studied to effectively utilize the apparatus.

SUMMARY OF THE INVENTION

With the foregoing considerations in mind, the instant inventor contemplates a genealogy apparatus which includes a substantially flat playing board having a plurality of stations thereon, each of which represents an individual. The stations are arranged in a plurality of columns wherein each column represents a generation and wherein each successive column has half the number of stations as the preceding column. The individual stations of each column are juxtaposed with a pair of stations in the preceding column so that the pairs of stations represent parents and the individual stations represent children. Each station is color coded according to whether the station is maternal or paternal and according to the sex of the individual meant to be associated therewith. Three-dimensional playing pieces are provided for mounting on the playing board at the stations wherein each playing piece has indicia thereon identifying it with a particular individual.

The afore-described apparatus may be used with any genealogical study or family tree. A preferred embodiment utilizes a famous person and the "Prince of Wales" is used as an example of such a person.

DETAILED DESCRIPTION OF THE PREFERRED EMBODIMENT

The current apparatus is designed to facilitate group participation in the construction of the family trees of famous and/or noble individuals given certain nominal (name-related) and familial (family-related) information about such persons and their ancestors. The invention is designed to be used in a leisure-time setting by a mature group of up to four individuals, but may also be utilized in an educational environment because of its historical and biographical content.

It is composed of four principal elements; (1) a pedigree surface or ancestral chart; (2) prism-like data blocks bearing nominal and familial information about individual ancestors; (3) an instruction set; and (4) an answer key. Acting separately and in combination these elements:

(a) provide each user with an understanding of the relationship various family members have with a PRINCIPAL or central individual;

(b) provide each user with the specific nominal and familial information necessary to choose amongst locational alternatives in the construction of the pedigree;

(c) provide each user with a convenient means with which to record decisions made with regard to these locational alternatives;

(d) provide all users with an equal opportunity to view the pedigree from their respective vantage points during its construction;

(e) provide a convenient means by which the locational decisions of one user may be readily checked by others as construction proceeds; and (f) provide a means by which the end product of the construction activity may be verified with historically accepted fact.

The specific capabilities embodied in the current device will be made clearer by the following detailed description of its elements as applied to the ancestral history of His Royal Highness Charles, Prince of Wales—Heir Apparent to the Throne of Great Britain.

The Board

Figure 1:
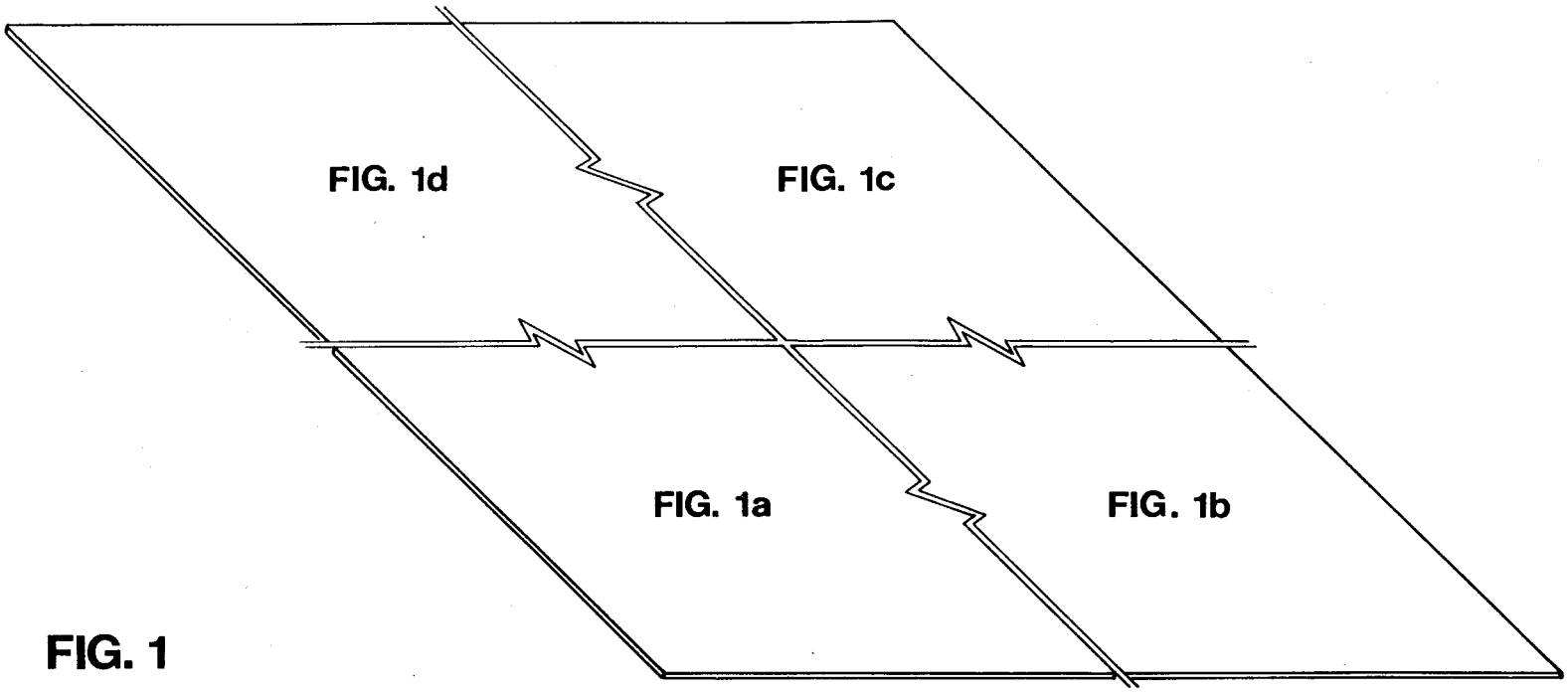
FIG. 1 is an oblique view of the board divided into four subsections.
Figure 1A:
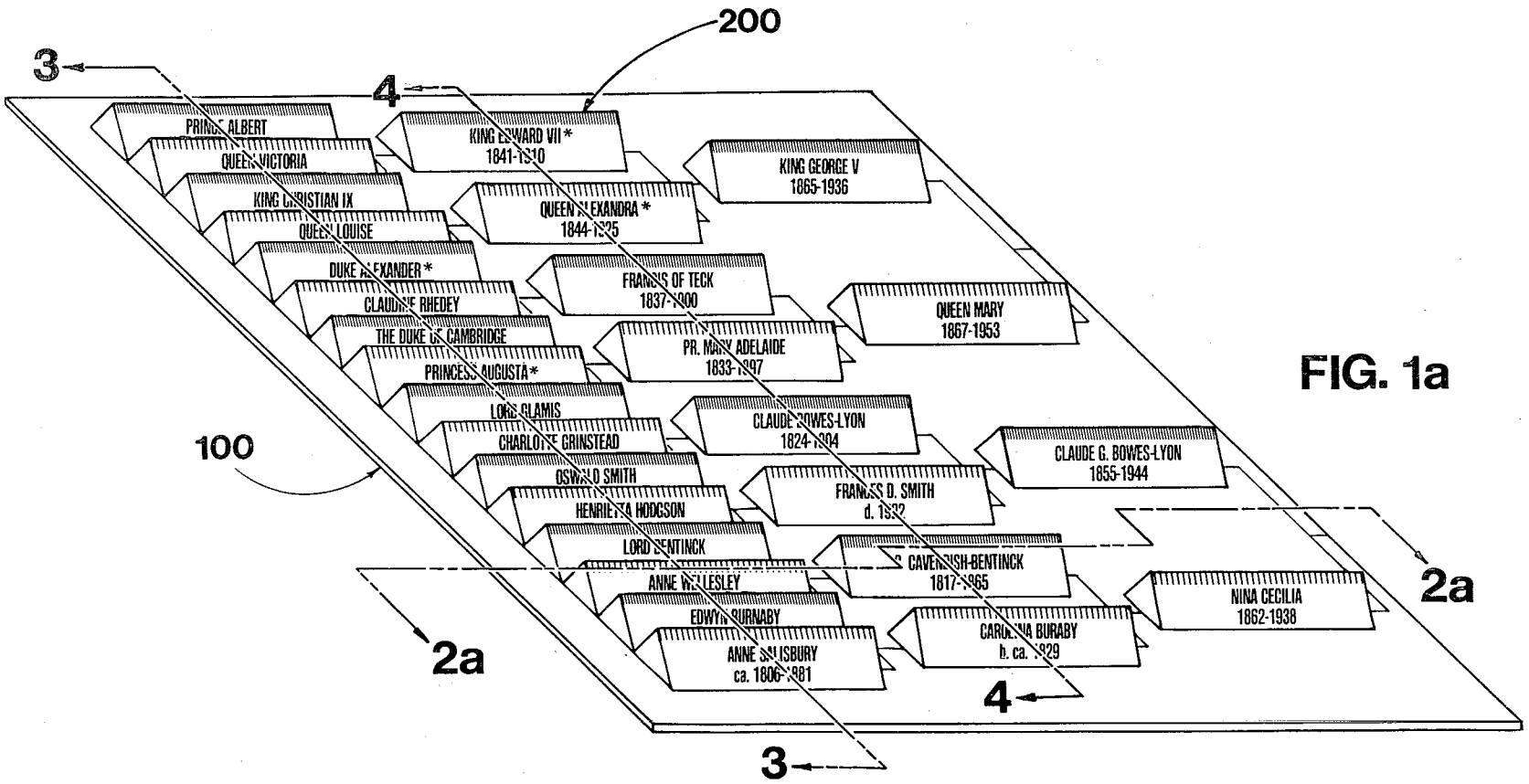
FIGS. 1*a*–1*d* are each an oblique view of one of the subsections shown in FIG. 1 and the prism-like structures (prisms) placed thereon in accordance with the specification of the current invention, showing nominal (name-related) information on individuals, such information being arranged in a manner that it constitutes the ancestral history of "Charles, Prince of Wales" (the Principal)
Figure 1B:
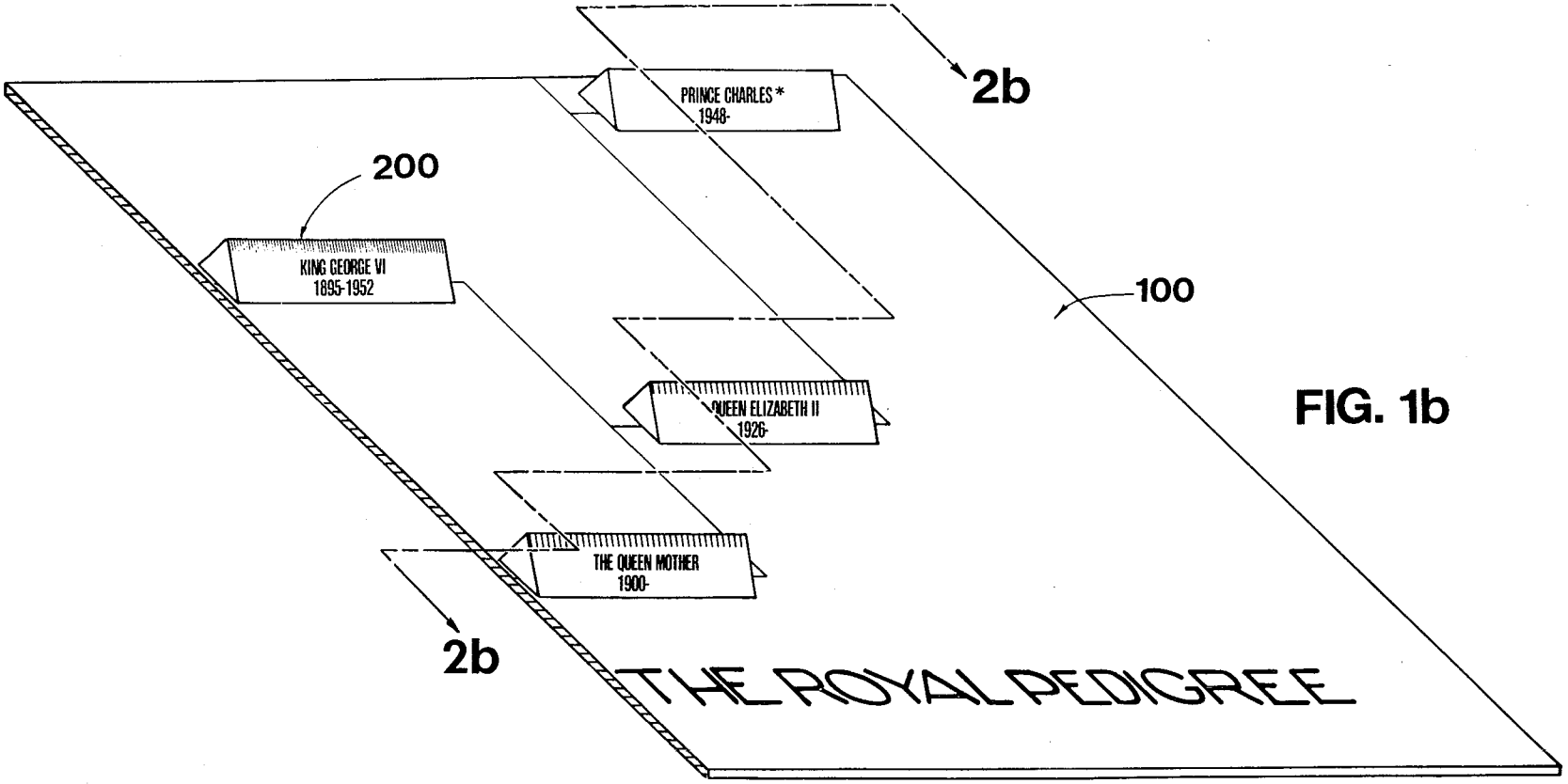
Figure 1C:
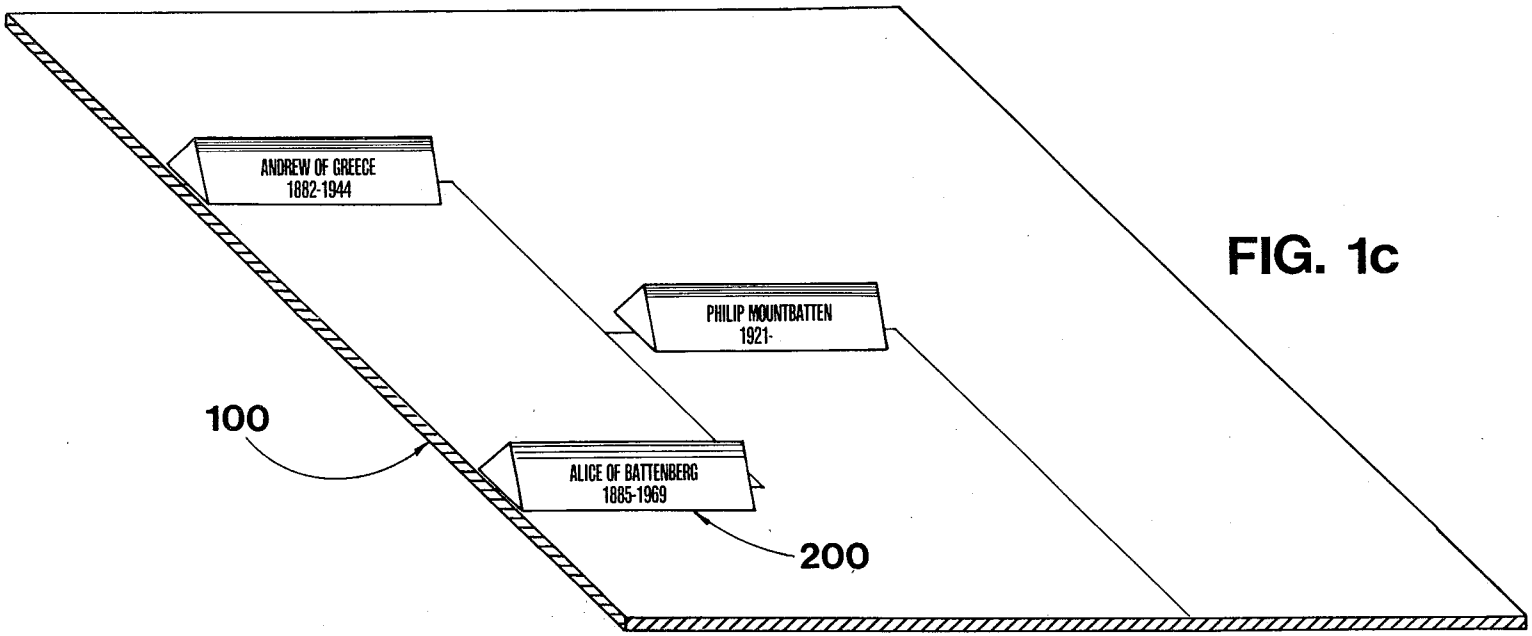
Figure 1D:
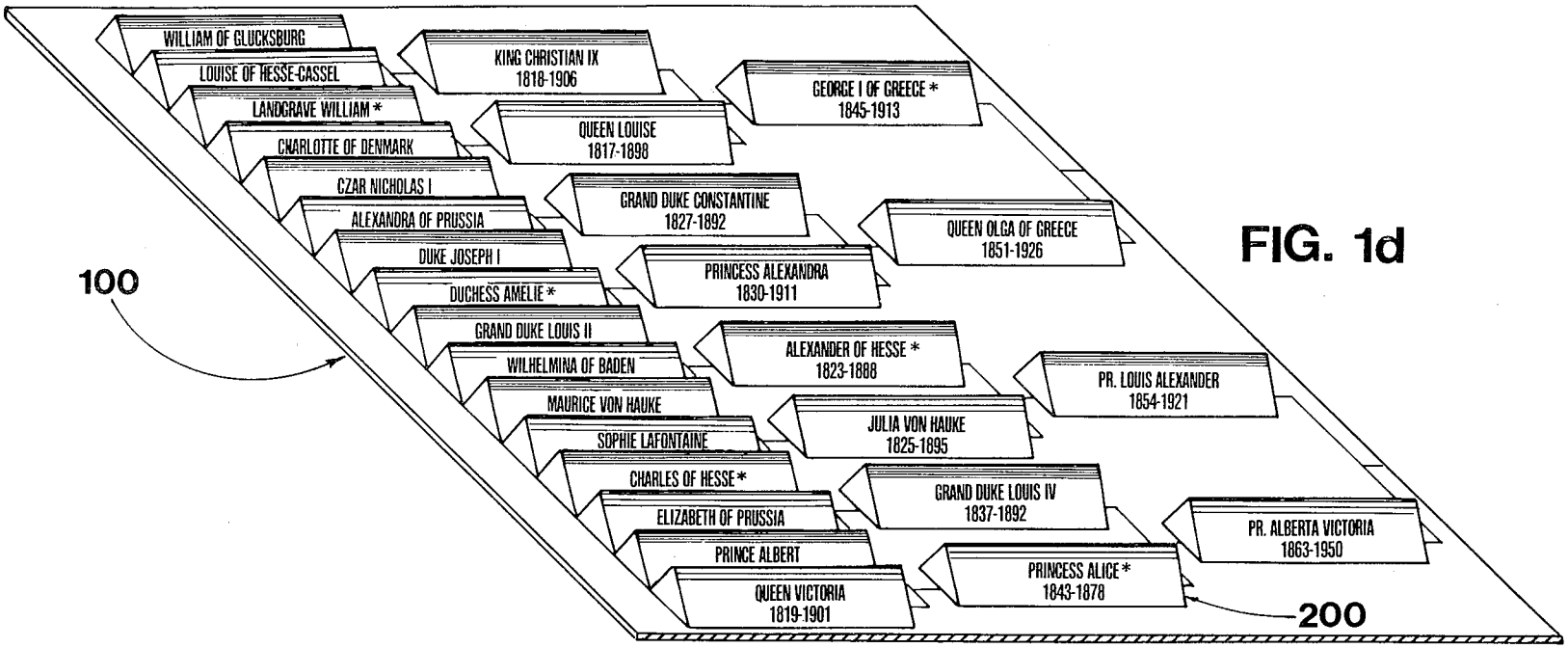
Figure 2A:
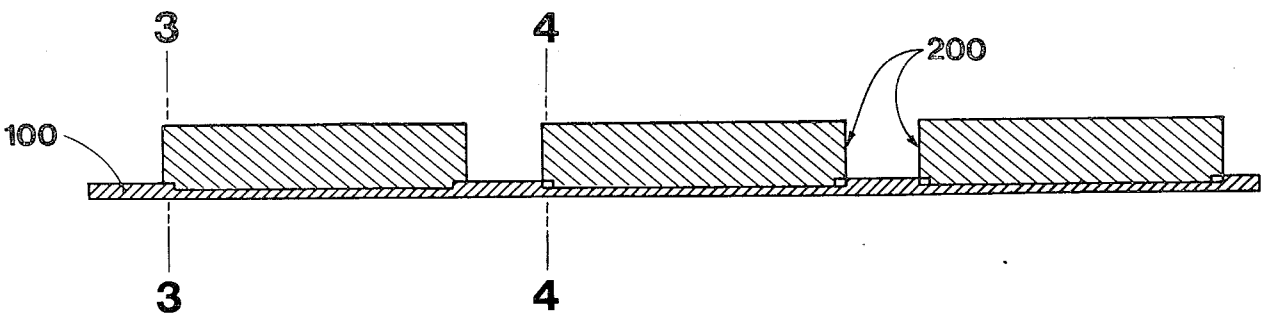
FIGS. 2*a* and 2*b* are sectional views of FIG. 1*a* taken along line 2*a*, and of FIG. 1*b* taken along line 2*b* respectively; through the apex edges of select prisms spanning all six generations incorporated within the design of the apparatus.
Figure 2B:
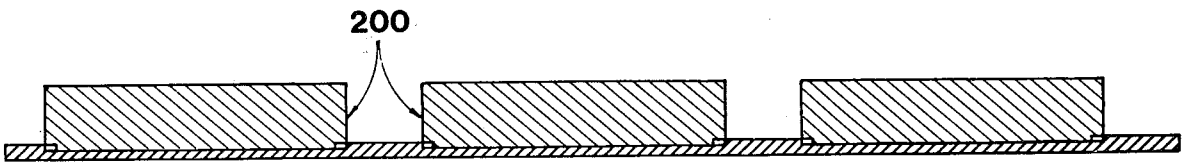
Figure 3:
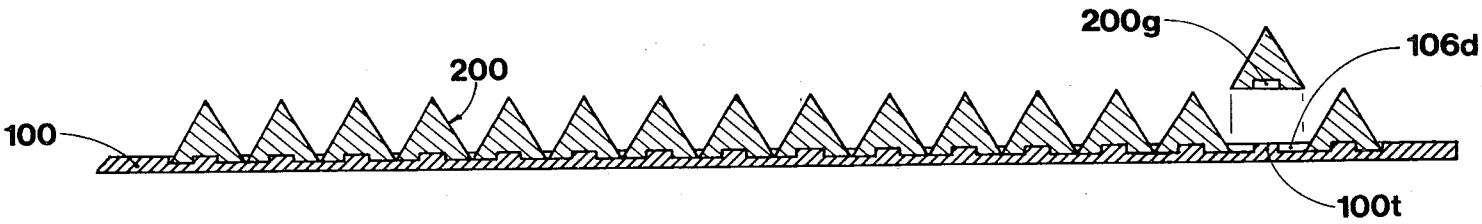
FIG. 3 is a sectional view of FIG. 1 taken along line 3 of FIG. 1*a* showing the tongue and groove arrangement of the board and the prisms representing the sixteen great-great-great-grandparents of the principal within his maternal ancestry.
Figure 4:
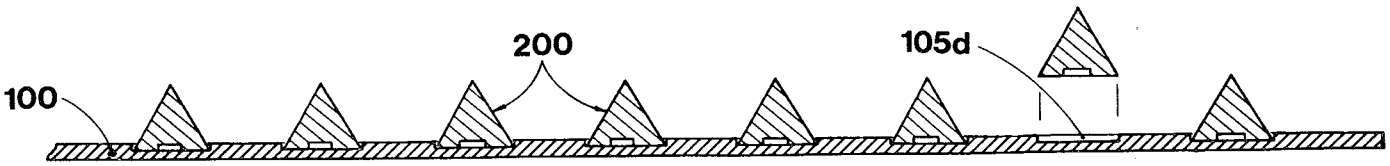
FIG. 4 is a sectional view of FIG. 1 taken along line 4 of FIG. 1*a* showing the prisms representing the eight great-great-grandparents of the principal within his maternal ancestry, said prisms being seated in rectangular troughs or depressions in the board.
Figure 5:
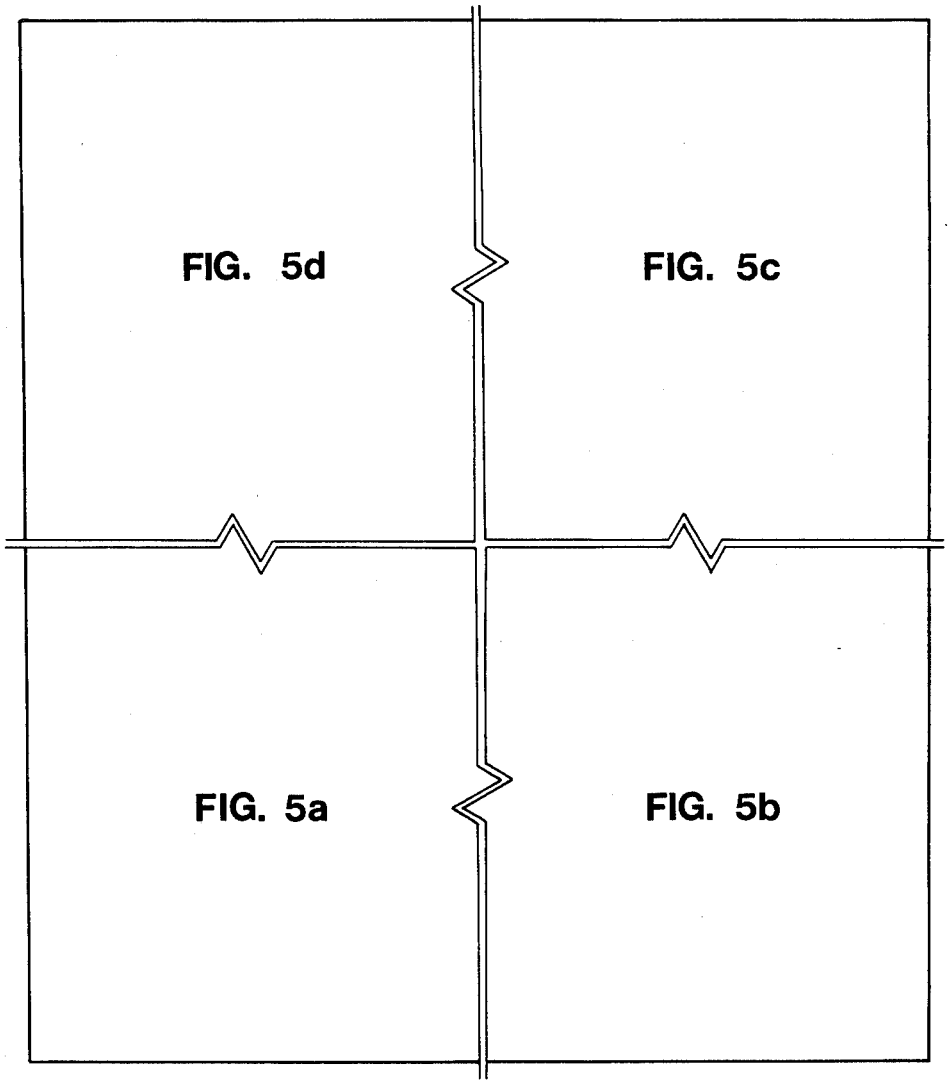
FIG. 5 is a plan view of the board divided into four subsections.
Figure 5A:
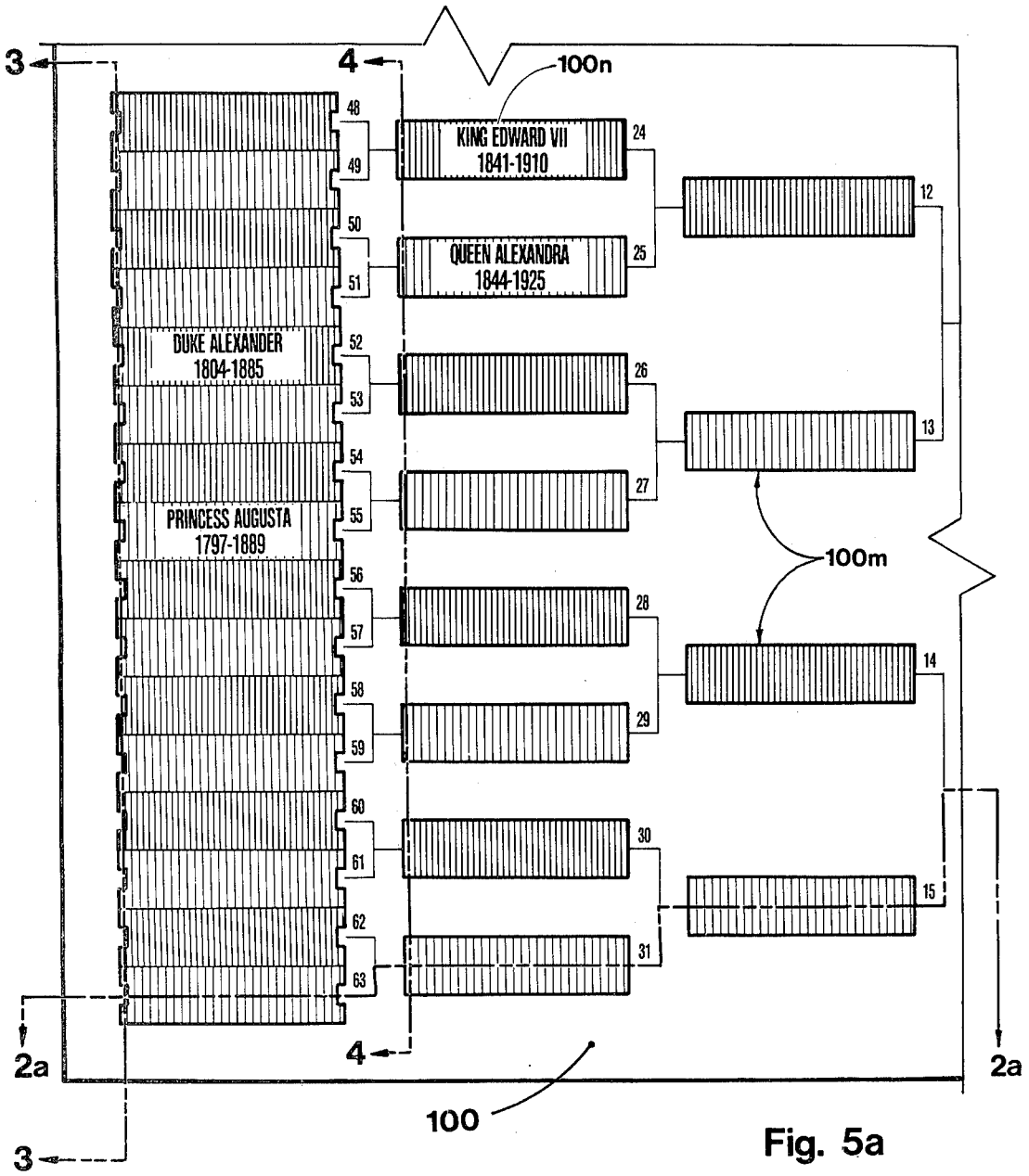
FIGS. 5*a*–5*d* are each a plan view of one of the four subsections shown in FIG. 5 absent the prisms of FIG. 1*a*–1*d* showing the disposition of the rectangular markings (ancestral sites) and the numbering and coloring schemes associated with them, as well as the disposition of the many starting points.
Figure 5B:
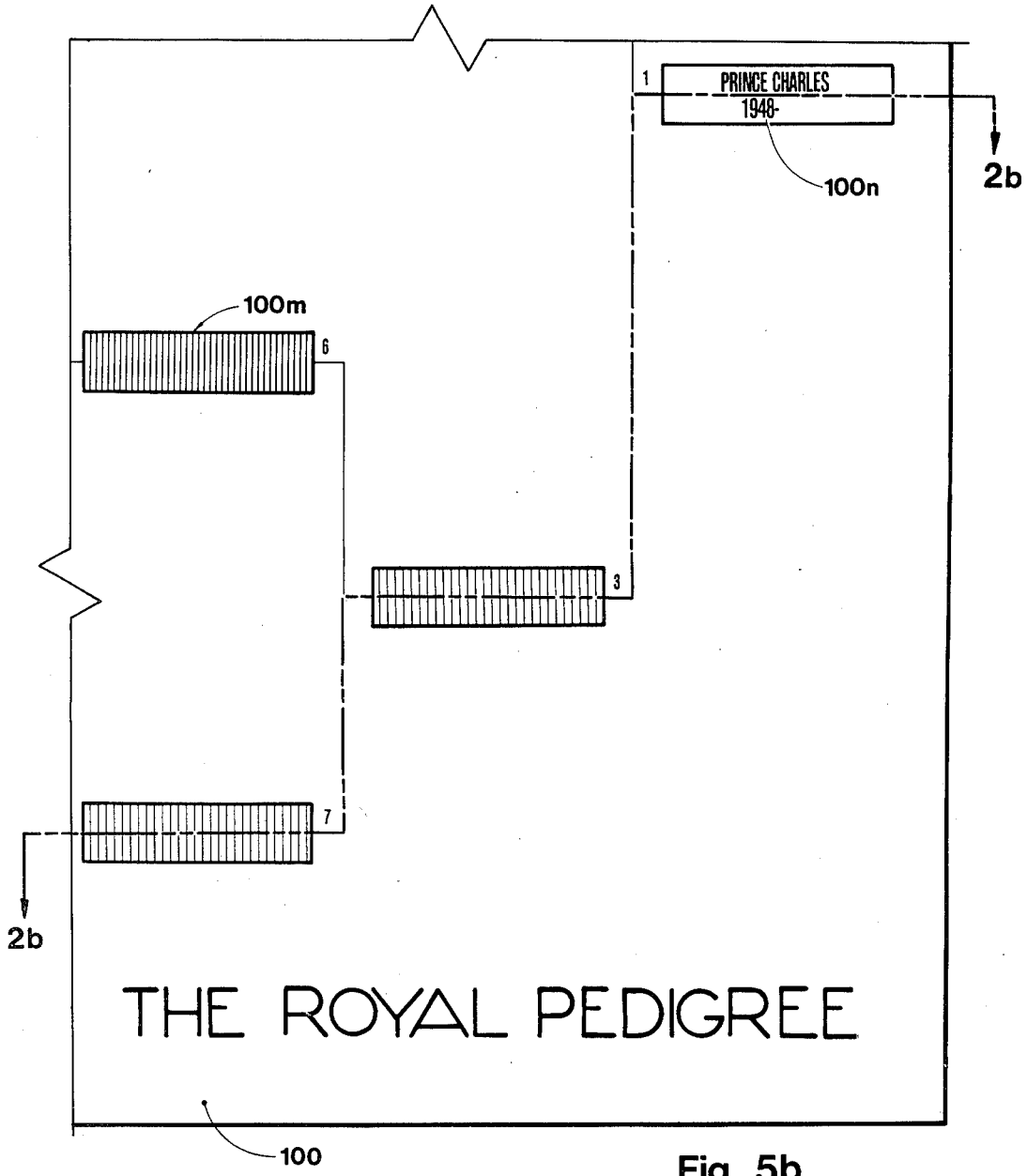
Figure 5C:
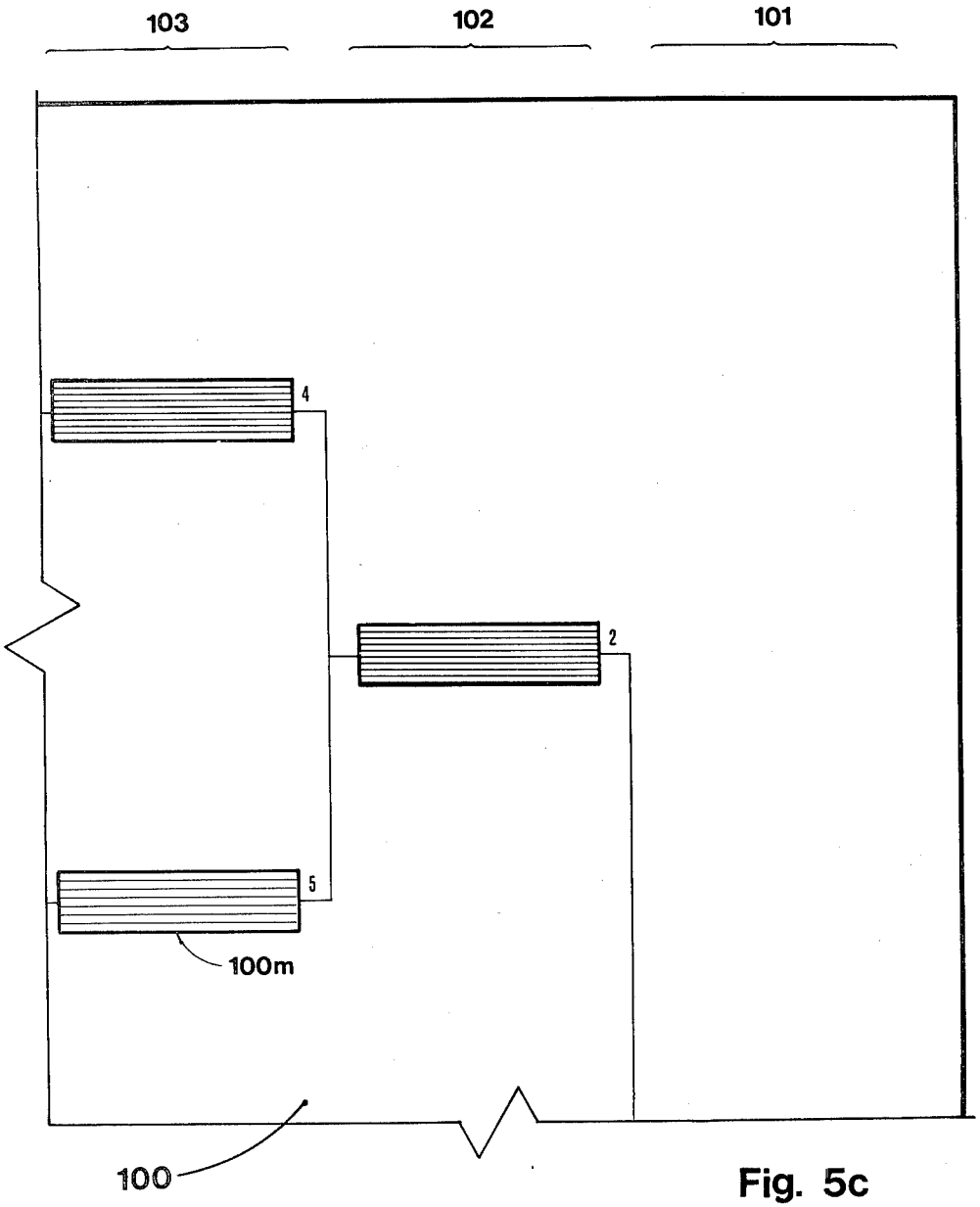
Figure 5D:
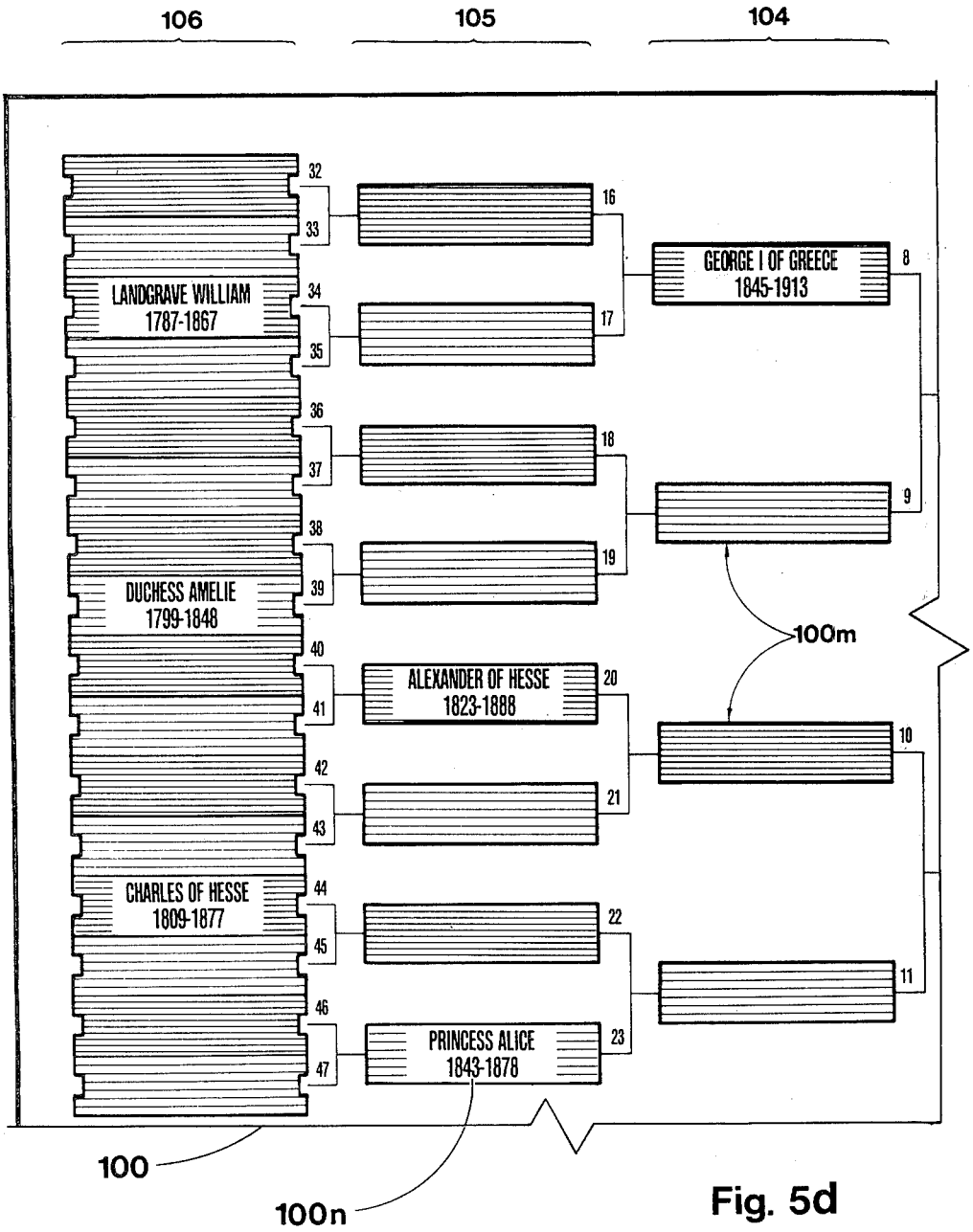

The playing board or pedigree surface (100; FIGS. 1, 2, 3, 4, 5 and 6) is the central element of the current device. It is planar in construction and rectangular in shape to form a panel measuring approximately 29 inches by 30 inches. It bears the markings of a conventional ancestral chart which is capable of displaying in generational sequence the parents, grandparents, great-grandparents, great-great-grandparentes and great-great-great-grandparents of a single individual or principal. Such markings form six successive evenly spaced columns (101, 102, 103, 104, 105 and 106; FIG. 5) starting at one side of the board (100) and ending at the other.

Each of the columns (101 through 106) contains rectangular markings or stations (100*m;* FIG. 5) within which all generational members can be recorded. When properly recorded, the names and anniversary dates of such members lie perpendicular to the longitudinal axis of the column in which they are found.

The subject or principal in column 1 (101) is the sole member of the first generation. His two parents in column 2 (102) are the sole members of the second or preceding generation. The subject's four grandparents in column 3 (103) are the sole members of the third or next preceding generation and so on up to the principal's thirty-two great-great-great-grandparents in column 6 (106) who are the sole members of the sixth or fifth preceding generation.

Columns are juxtaposed and connected graphically in such a manner that the parents of any individual can be deduced from amongst members of the preceding generation. The rectangular marking (100*m*) representing the principal in column 1 (101), for example is connected in a steplike rectilinear fashion to those representing each of his parents in column 2 (102). They in turn are connected in similar fashion to each of their parents (the principal's maternal and paternal grandparents) in column 3 (103). The process continues in similar fashion so that the principal may trace his line of descent in a steplike fashion from anyone of thirty-two great-great-great-grandparents in column 6 (106). The parents of the members of the sixth generation are not subject for consideration in the design of this apparatus.

Further, ancestral sites (100*m*) on the pedigree surface associated with the principal's maternal ancestry (those associated with his mother and her direct ascendants) are coded with a particular color and those associated with his paternal ancestry (those associated with his father and his father's direct ascendants) are coded with distinctively different color. Female sites are coded with lighter shades of their respective colors and male sites are coded with darker shades.

A conventional numbering scheme is used with the principal's site assigned the number one and members of each preceding generation assigned progressively higher consecutive integer values in such a manner that all males are even and all females are odd. In this manner a total of six-three numerical assignments are made.

Accordingly, column 1 (101) will contain only ancestral site number one; column 2 (102) will contain ancestral sites 2 and 3; column 3 (103) will contain ancestral sites 4, 5, 6 and 7; column 4 (104) will contain ancestral sites 8, 9, 10, 11, 12, 13, 14 and 15; column 5 (105) will contain ancestral sites 16 through 31; and column 6 (106) will contain ancestral sites 32 through 63.

For each individual represented in columns 1 through 5, (101 through 105, respectively), a rectangular trough, indentation recess or depression (105*d;* FIGS. 4 and 6) forms a station in the board to accomodate a prism-like structure, or three-dimensional playing piece, (200; FIGS. 1, 2, 3, 4 and 6) carrying both nominal and familial information. Each such trough has its long dimension perpendicular to the longitudinal axis of the column. Horizontal and vertical registration of the prism (200) is achieved through the mating of trough (105*d*) and prism (200) during pedigree construction.

In column 6 (106) where the spacing of prisms (200) is such that they are actually edge-on-edge, vertical registration is carried out by a tongue (100*t;* FIGS. 3 and 6) and groove (200*g;* FIGS. 3 and 6) system. Small box-like grooves (200*g*) are present at both ends of one of the three rectangular surfaces of each prism (200). These grooves (200*g*) are designed to mate with tongues (100*t*) at the edges of two large depressions (106*d;* FIG. 6) in this column (106). Each of these depressions (106*d*) are large enough to accomodate one-half of the thirty-two prisms (200) intended for this column (106).

Each of these troughs or depressions (106*d*) is approximately rectangular in shape having its longitudinal dimension parallel to the longitudinal axis of the column (106). It is the longitudinal edges of these troughs which have been provided with the box-like tongues (100*t*) to mate with similar structures (200*g*) on the prisms (200).

Each of the troughs (106*d*) is separated by a small space which delimits the boundary between the maternal and paternal ancestry of the principal. Each of the troughs (106*d*) is equal in width to the length of one of the rectangular surfaces on a prism (200). In length, each trough (106*d*) is equal to sixteen times the width of the rectangular surface on a prism (200). This configuration also provides horizontal registration for sixteen prisms (200) in each trough, the prisms' horizontal movement being confined by the width of the trough.

With horizontal and vertical registration provided in this manner each of the prisms (200) in column 6 (106) lie in the same general orientation as those in other columns (101 through 105), but with no space separating adjacent prisms in either of the two troughs (106*d*). As is readily seen in FIG. 1 the stations converge in paternal and maternal stepped arrays to the principal station.

Figure 6:
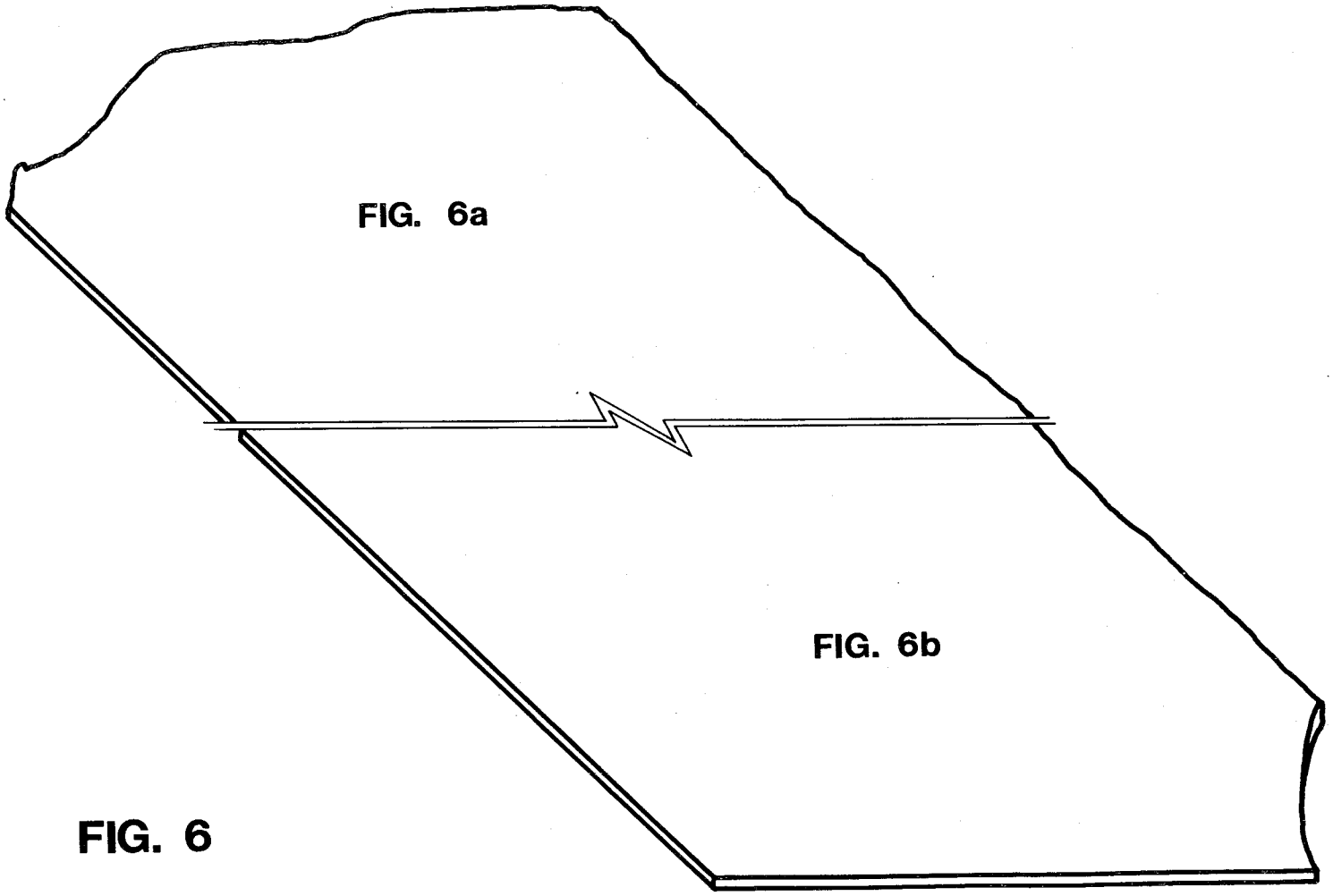
FIG. 6 is an enlarged oblique view of a fragment of the board of FIG. 1 divided into two subsections.
Figure 6A:
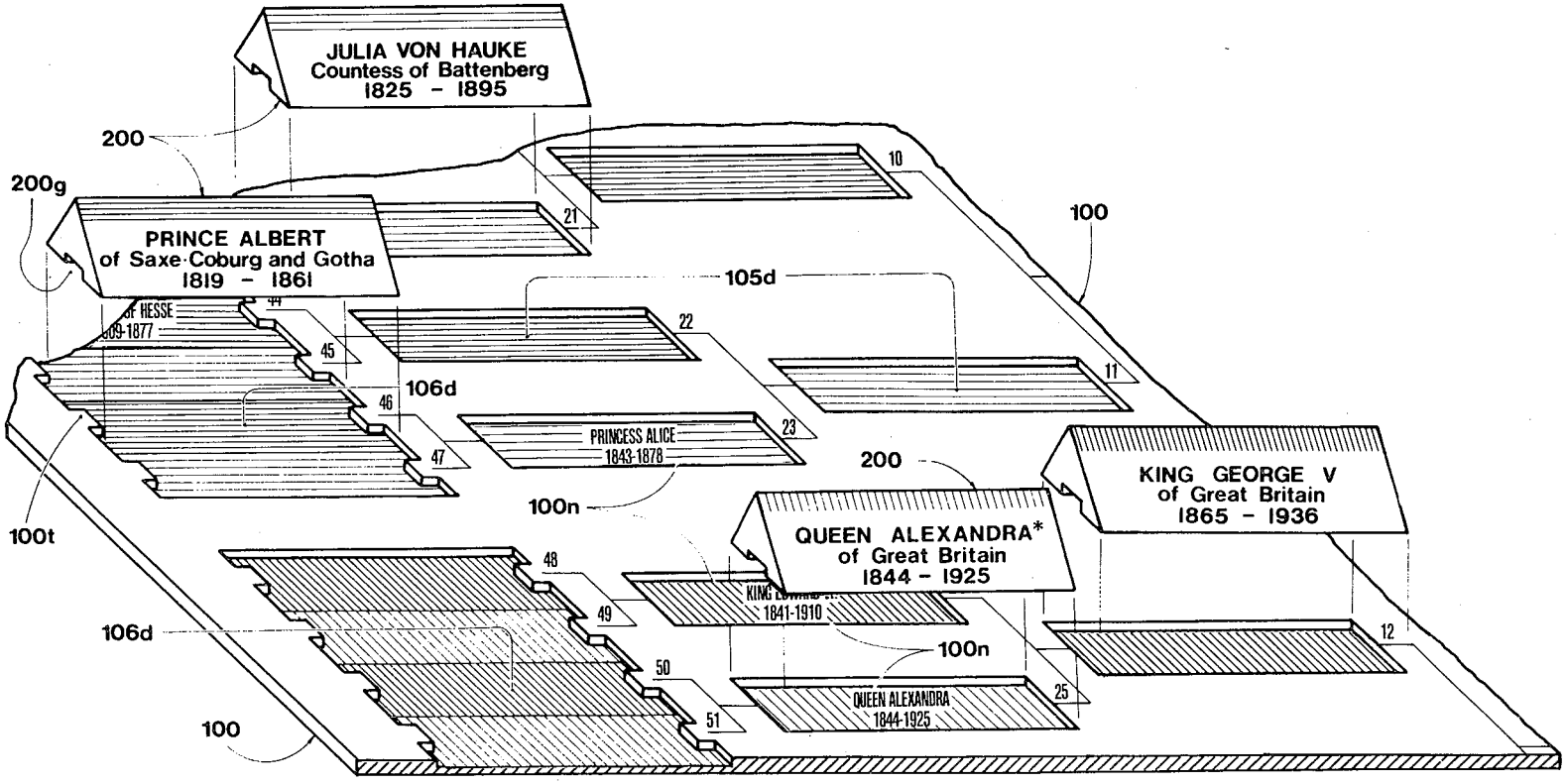
FIGS. 6*a* and 6*b* are oblique views of the board subsections shown in FIG. 6 each showing select prisms poised over their proper locations and the color-coding scheme on both the board and the prisms.
Figure 6B:
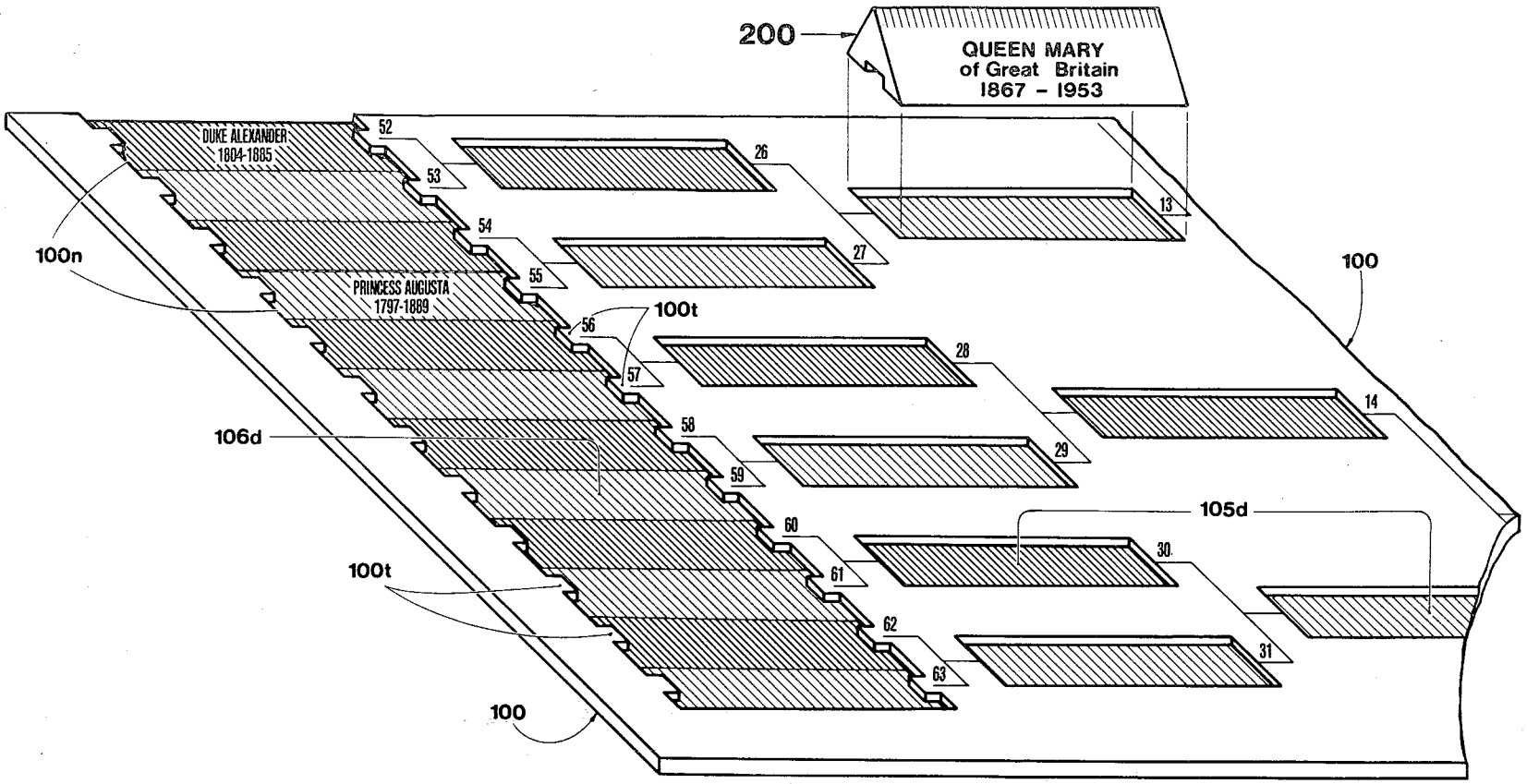
Figure 7A:
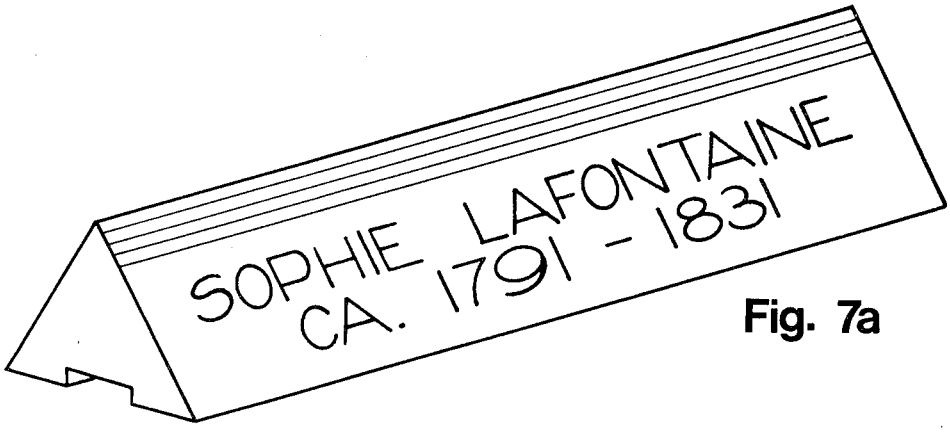
FIGS. 7*a*–7*f* are views of a typical prism from FIGS. 1*a*–1*d* showing plan, elevation and end views accompanied by top and bottom perspectives.
Figure 7B:
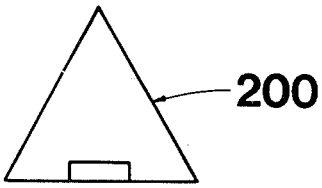
Figure 7C:
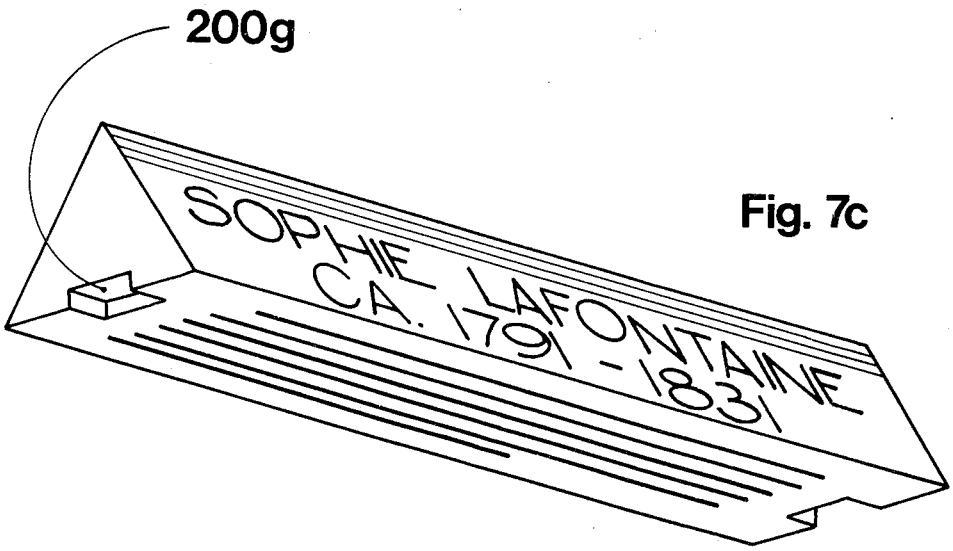
Figure 7D:
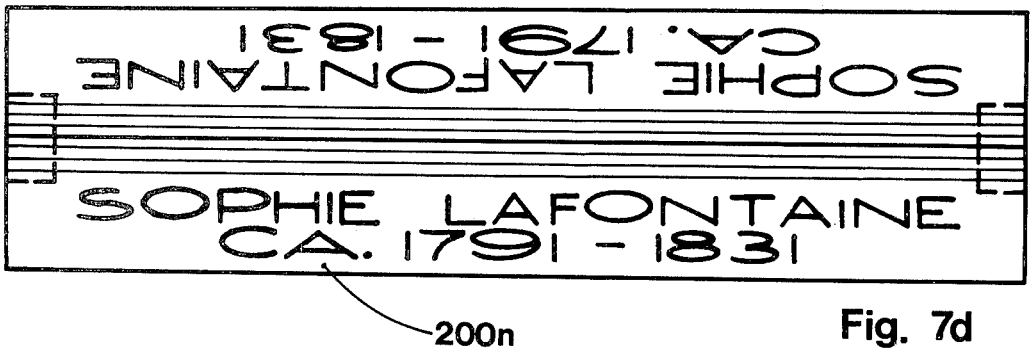
Figure 7E:
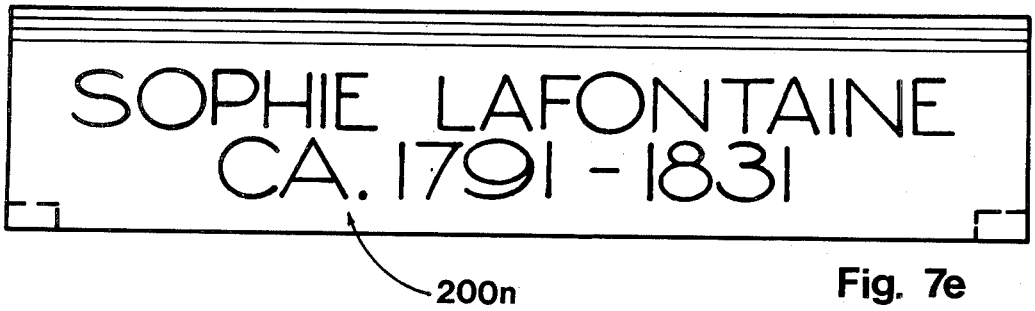
Figure 7F:
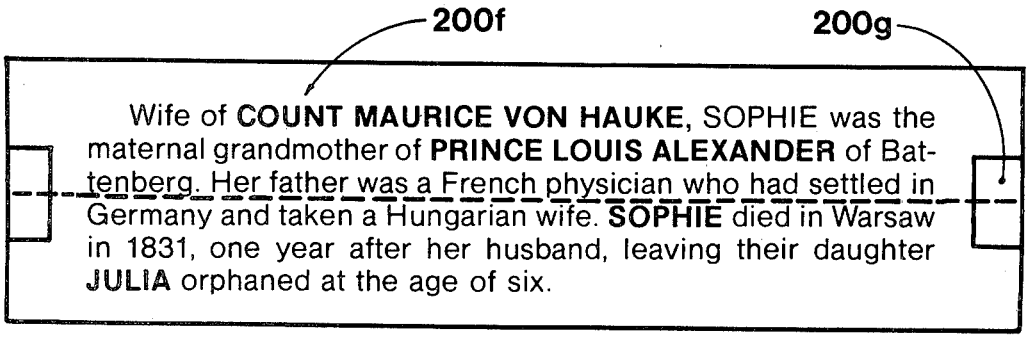

In order to facilitate startup of the exercise, the positions of certain ancestors within the pedigree are identified on the board (100). Each of these positions is labeled with word indicia the name and anniversary dates (100*n*; FIGS. 5 and 6) of the appropriate ancestor. In the current embodiment of the invention, the starting points are labeled as follows:

| NUMERICAL ASSIGNMENT | NAMES AND ANNIVERSARY DATES | |
|---|---|---|
| 1 | Charles, Prince of Wales | (1948- ) |
| 8 | George I, King of the Hellenes | (1845-1913) |
| 20 | Prince Alexander of Hesse | (1823-1888) |
| 23 | Princess Alice of Great Britain | (1843-1878) |
| 24 | King Edward VII of Great Britain | (1841-1910) |
| 25 | Queen Alexandra of Great Britain | (1844-1925) |
| 34 | William, Landgrave of Hesse-Cassel | (1787-1867) |
| 39 | Duchess Amelie of Wurttemberg | (1799-1848) |
| 44 | Prince Charles of Hesse | (1809-1877) |
| 52 | Duke Alexander of Wurttemberg | (1804-1885) |
| 55 | Augusta, Princess of Hesse-Cassel | (1797-1889) |

The Prisms or Three-Dimensional Playing Pieces

The data-bearing prism-like structures, prisms, (200; FIGS. 1, 2, 3, 4, 6 and 7) one for the principal and one for each of his sixty-two ancestors, are the primary means used for the transmission of nominal (200*n*; FIG. 7) and familial (200*f*; FIG. 7) information. Each is prismatic in shape having ends which are equal and parallel triangles with interior angles approximating 60° and three sides which are rectangles measuring approximately 0.9 inch by 4.0 inches.

The arrangement of nominal (200*n*) and familial (200*f*) information on these rectangular surfaces is a significant aspect of the invention. Nominal information (generally the name and anniversary dates of a particular ancestor) (200*n*) is printed as word indicia on two of the prism's three rectangular surfaces. The printing is accomplished in such a manner that the first or uppermost line of type on each surface is set parallel to and just below the one common edge shared by both rectangles.

Familial information (200*f*) relating the individual to one or more persons in the pedigree along with biographical text is printed on the third and grooved rectangular surface. The printing is accomplished so that lines of type are simply set parallel to the two longitudinal edges of the rectangle.

It will be found that when placed in any trough (105*d* and 106*d*) such that the rectangular surface containing familial information (200*f*) is face down, nominal information (200*n*) on the prism is plainly visible to each of four users situated around the periphery of the board. This statement will be found to be true regardless of the number or combination in which prisms (200) are placed on the board (100).

Prisms (200) associated with known or starting points have asterisks after the first line of nominal information (200*n*) on each face. These are meant to indicate to the user that the proper ancestral site (100*m*) may be determined by simply correlating the nominal information (200*n*) on the prism (200) with the nominal information (100*n*) at one of the eleven starting points on the board (100).

The Instruction Set

The instruction set describes an orderly manner for a group of up to four individuals to construct the pedigree. The task is accomlished in much the same way that professional genealogists go about their business. That is, names, anniversary dates and family relationships are gathered and logical deductions made as to the placement of ancestors in the pedigree. All the research has already been done, however, so that the emphasis in the current device is on correct placement and knowledge of family relationships.

The instruction set uses a simple algorithm for allocating ancestral information among various users. At the start of the exercise, each user selects at random five ancestral prisms (200) from a pool containing all sixty-three. Having digested the information thereon, each user separately and in turn tries to correctly position a single family member on the pedigree surface (100). Should a placement be made, the nature of the family relationship which permits the placement is read aloud from the prism (200).

For example, "Elizabeth II, mother of Charles, Prince of Wales" would be read as Her Majesty's prism (200) is placed onto the pedigree surface (100). As placements are made, additional prisms (200) are drawn from the pool at random so that, supply permitting, each user always has five prisms (200).

Users are instructed that they may skip a turn (pass) at any time. However, should all users pass on any round, all prisms (200) are returned to the pool and five prisms are again selected at random by each user.

The interrelationships between various ancestral sites (100*m*) are illustrated by a set of diagrams (FIGS. 8*a*, 8*b*, 8*c*, and 8*d*) provided in the instructions. Each takes the basic family unit formed by the first three generations on the pedigree surface (100) and looks at the relationships therein from different vantage points. Appropriately, each of the diagrams has seven rectangular markings (300*m*) arranged in a manner analogous to the seven rectangular markings (100*m*) in columns 1, 2 and 3 (101, 102 and 103 respectively) on the board (100).

Figure 8A:
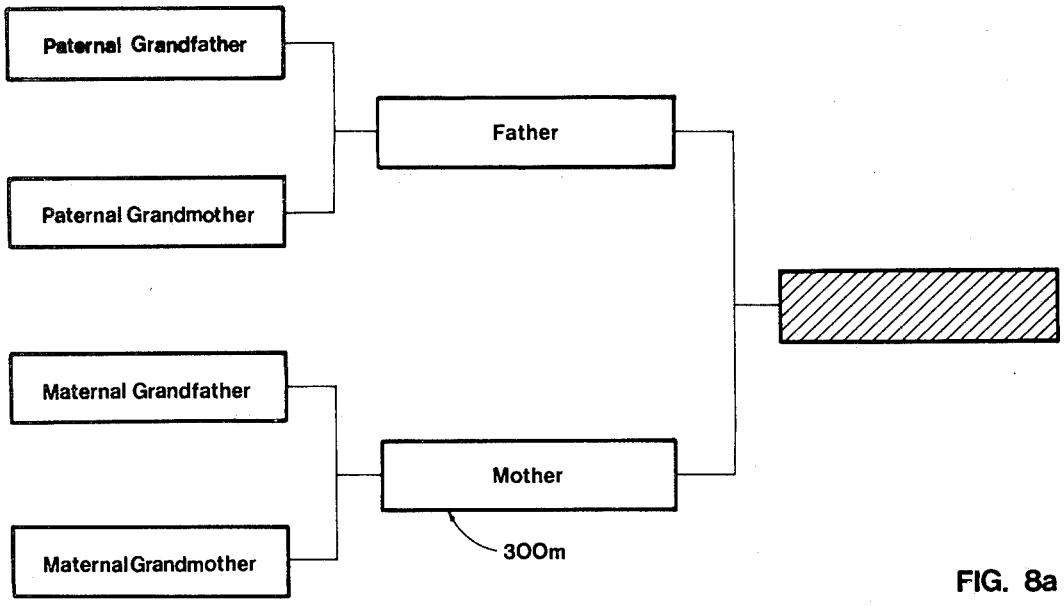
FIG. 8*a* is a diagram constituting a portion of the instruction set of the current invention showing the basic seven-member family unit spanning three generations and the familial relationships found therein as seen from the vantage point of the youngest member (shown cross-hatched) of said family unit.

For example, FIG. 8*a* shows the relationships that members of the second and third generations have to the Prince of Wales, the sole member of the first generation. These are shown to be:

FATHER
MOTHER
PATERNAL GRANDFATHER
PATERNAL GRANDMOTHER
MATERNAL GRANDFATHER
MATERNAL GRANDMOTHER

Figure 8B:
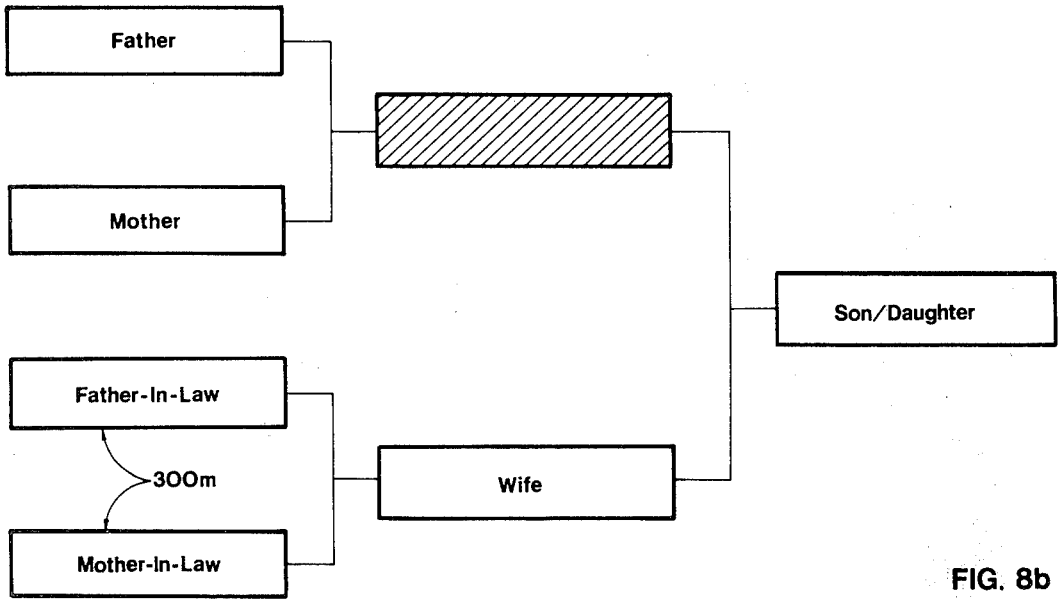
FIG. 8*b* is a diagram similar to FIG. 8*a* but showing familial relationships from the vantage point of the FATHER (shown cross-hatched) of the youngest member of the family unit.

FIG. 8*b* shows the relationships that a member of the second generation (specifically the Prince's FATHER) has with the other member of his own generation and with members of the first and third generations. These are shown to be:

WIFE
SON
FATHER
MOTHER
FATHER-IN-LAW
MOTHER-IN-LAW

Figure 8C:
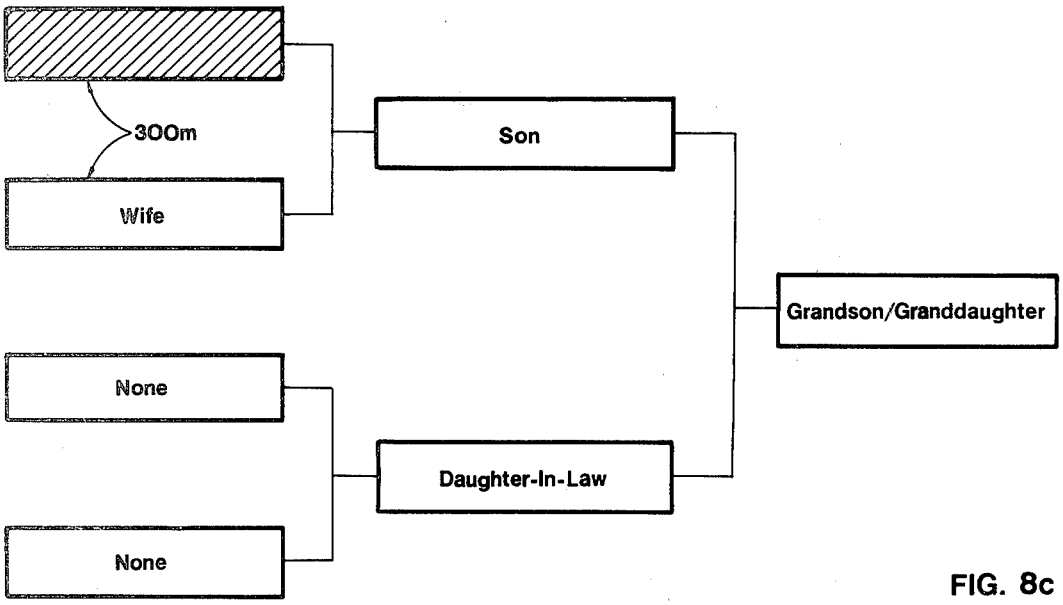
FIG. 8*c* is a diagram similar to FIG. 8*a*, but showing familial relationships from the vantage point of the PATERNAL GRANDFATHER (shown cross-hatched) of the youngest member of the family unit.

FIG. 8*c* shows the relationships that a member of the third generation (specifically the Prince's PATERNAL GRANDFATHER) has with members of his own generation and members of the first and second generation. These are shown to be:

WIFE
NONE
NONE
GRANDSON
SON
DAUGHTER-IN-LAW

Figure 8D:
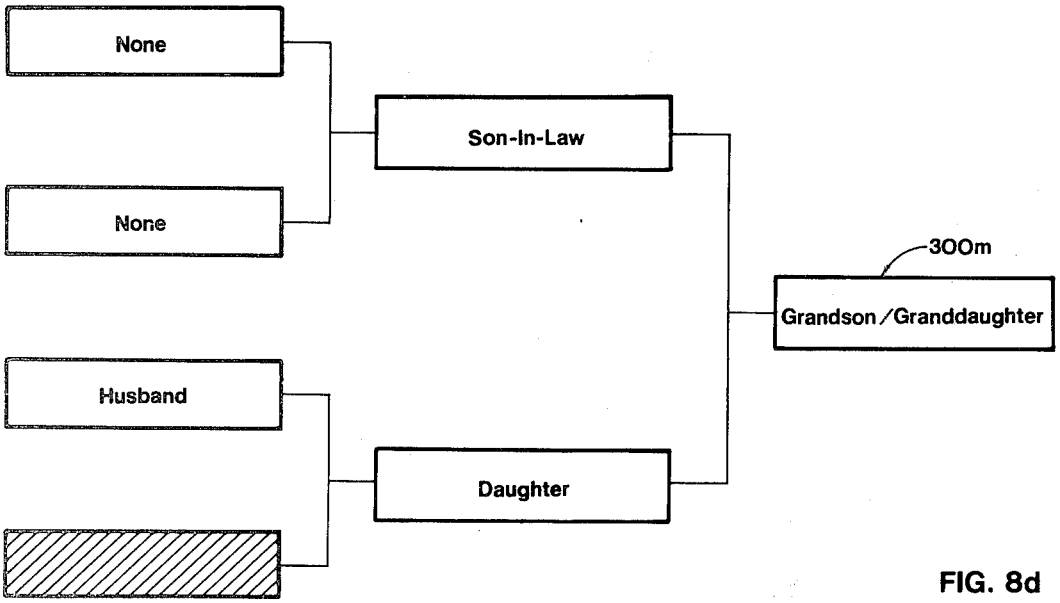
FIG. 8*d* is a diagram similar to FIG. 8*a*, but showing familial relationships from the vantage point of the MATERNAL GRANDMOTHER (shown cross-hatched) of the youngest member of the family unit.

FIG. 8*d* shows the relationships that a member of the third generation (specifically the Prince's MATERNAL GRANDMOTHER) has with members of her own generation and members of the first and second generation. These are shown to be:

HUSBAND
NONE
NONE
GRANDSON
SON-IN-LAW
DAUGHTER

These relationships can be used to interrelate and position generational members with respect to each other. It will be seen that this basic seven-member family grouping (i.e. PRINCIPAL, FATHER, MOTHER, PATERNAL GRANDFATHER, PATERNAL GRANDMOTHER, MATERNAL GRANDFATHER AND MATERNAL GRANDMOTHER) is repeated fifteen times throughout the pedigree.

The Prince's FATHER for example, belongs to a separate seven-member family grouping including his father and mother and their parents. In turn, the Prince's PATERNAL GRANDFATHER belongs to another basic family grouping including his father and mother and their parents. Further, it will be seen that the Prince's thirty-two great-great-great-grandparents in column 6 (106) form the tail ends of eight separate family groups of this type.

The following table enumerates all such family subgroupings within the pedigree with the youngest subgroup member listed as a reference point:

| FAMILY SUBGROUPS By Numerical Assignment | YOUNGEST SUBGROUP MEMBER |
|---|---|
| 1, 2, 3, 4, 5, 6, 7 | Charles, Prince of Wales |
| 2, 4, 5, 8, 9, 10, 11 | Philip Mountbatten, Duke of Edinburgh |
| 3, 6, 7, 12, 13, 14, 15 | Queen Elizabeth II of Great Britain |
| 4, 8, 9, 16, 17, 18, 19 | Prince Andrew of Greece |
| 5, 10, 11, 20, 21, 22, 23 | Princess Alice of Battenberg |
| 6, 12, 13, 24, 25, 26, 27 | King George VI of Great Britain |
| 7, 14, 15, 28, 29, 30, 31 | Queen Elizabeth, The Queen Mother |
| 8, 16, 17, 32, 33, 34, 35 | George I, King of the Hellenes |
| 9, 18, 19, 36, 37, 38, 39 | Queen Olga of Greece |
| 10, 20, 21, 40, 41, 42, 43 | Prince Louis Alexander of Battenberg |
| 11, 22, 23, 44, 45, 46, 47 | Princess Victoria Alberta of Hesse |

-continued

| FAMILY SUBGROUPS By Numerical Assignment | YOUNGEST SUBGROUP MEMBER |
|---|---|
| 12, 24, 25, 48, 49, 50, 51 | King George V of Great Britain |
| 13, 26, 27, 52, 53, 54, 55 | Queen Mary of Great Britain |
| 14, 28, 29, 56, 57, 58, 59 | Claude George, 14th Earl of Strathmore |
| 15, 30, 31, 60, 61, 62, 63 | Nina Cecilia, Countess of Strathmore |

In order to facilitate placement of prisms (200) in the appropriate ancestral sites (100*m*) each of the biographical sketches (200*f*) on the prisms (200) relates that particular ancestor to one or more members of the basic family subgroup in which he or she falls.

For example, the biographical sketch on the Queen Mother's prism reads:

"Maternal grandmother of Charles, Prince of Wales, the Queen Mother personally controlled and directed the upbringing of her two daughters Margaret and Elizabeth (now Elizabeth II) . . . "

Thus, the position of the Queen Mother is given with respect to the Prince of Wales (a known or starting point) and with respect to her daughter, Elizabeth II. If one considers the Queen Mother a member of the basic family unit formed by all members of the first three generations on the pedigree surface (100), correct placement involves positioning the Queen Mother's prism (200) at an ancestral site analogous to that of the MATERNAL GRANDMOTHER of FIG. 8*a*.

The Queen Mother's prism (200) could also have been placed in a position analogous to the PRINCIPAL of FIG. 8*d* had the prism (200) of her daughter, The Queen, already been correctly positioned on the pedigree surface (100). In a similar manner, the positions of all ancestors can be determined within the context of the fifteen family subgroups throughout the pedigree and the eleven starting points mentioned earlier in connection with the design of the board (100).

A note on FIGS. 8*b*, 8*c* and 8*d*: The equivalent male/-female relationships (i.e. son/daughter, grandson/-granddaughter) given in the initial column of each of these diagrams merely extends their usefulness to family subgroupings other than that which includes the Prince of Wales.

As pedigree construction proceeds, users are encouraged to re-read familial information (200*f*) on prisms (200) that have already been positioned on the board (100) by others. This process is facilitated by the ready availability of familial information (200*f*) on the underside (unseen side) of each prism (200).

The Answer Key

Figure 9:
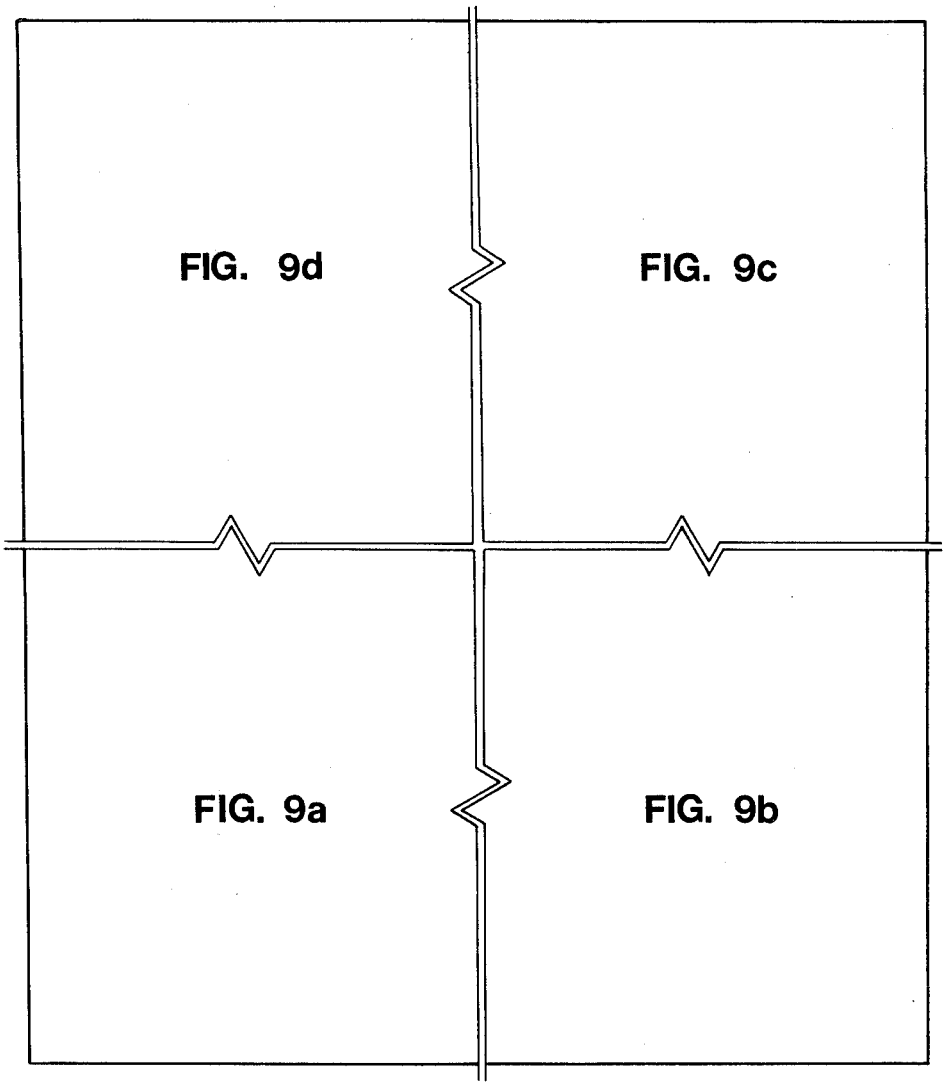
FIG. 9 is a plan view of the answer key divided into four subsections.
Figure 9A:
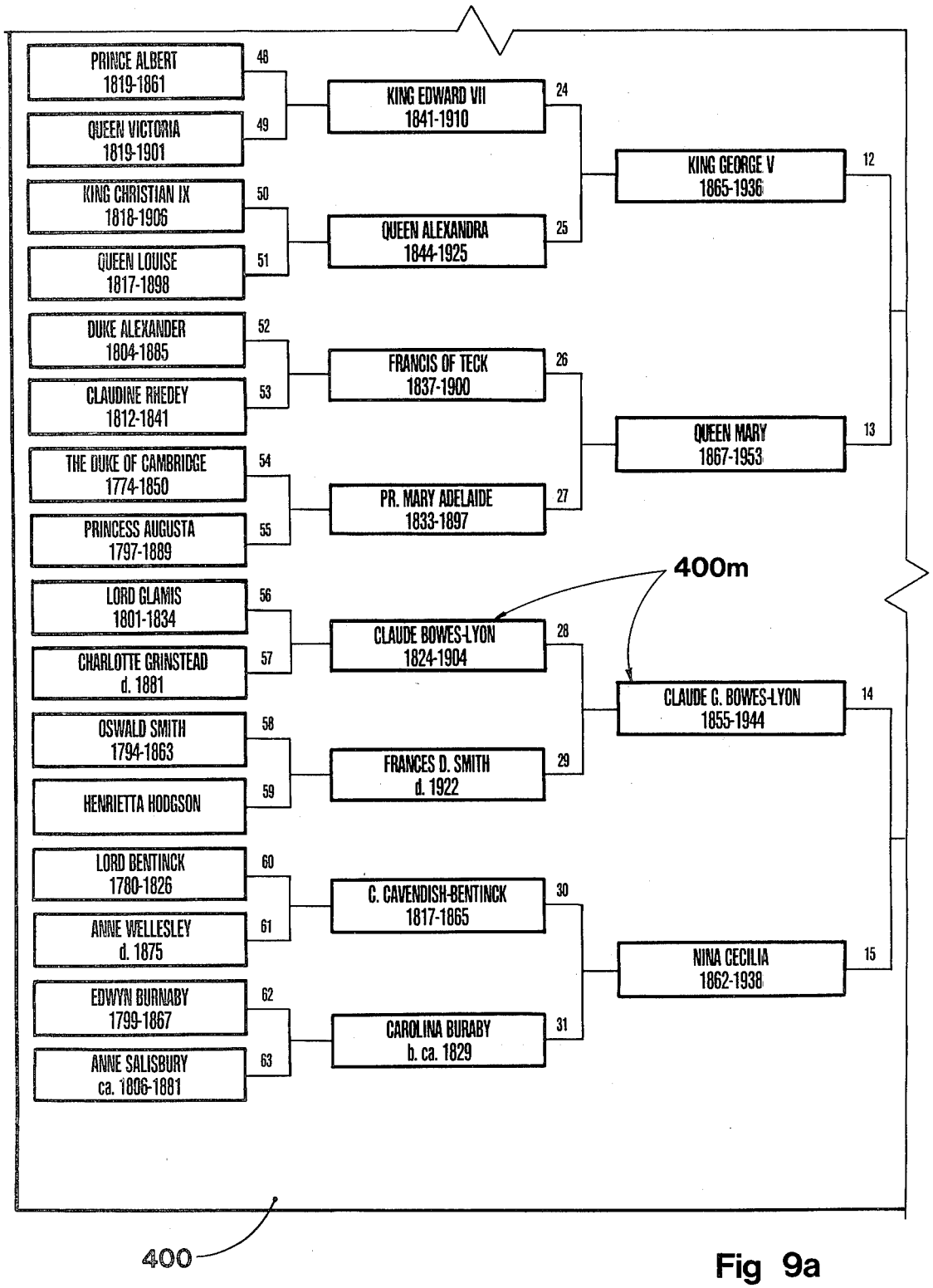
FIGS. 9*a*–9*d* are each a plan view of one of the key subsections shown in FIG. 9, showing numbered rectangular markings arranged in a manner similar to those markings on the board of FIG. 1 and containing therein the name and anniversary dates of the individuals in the pedigree.
Figure 9B:
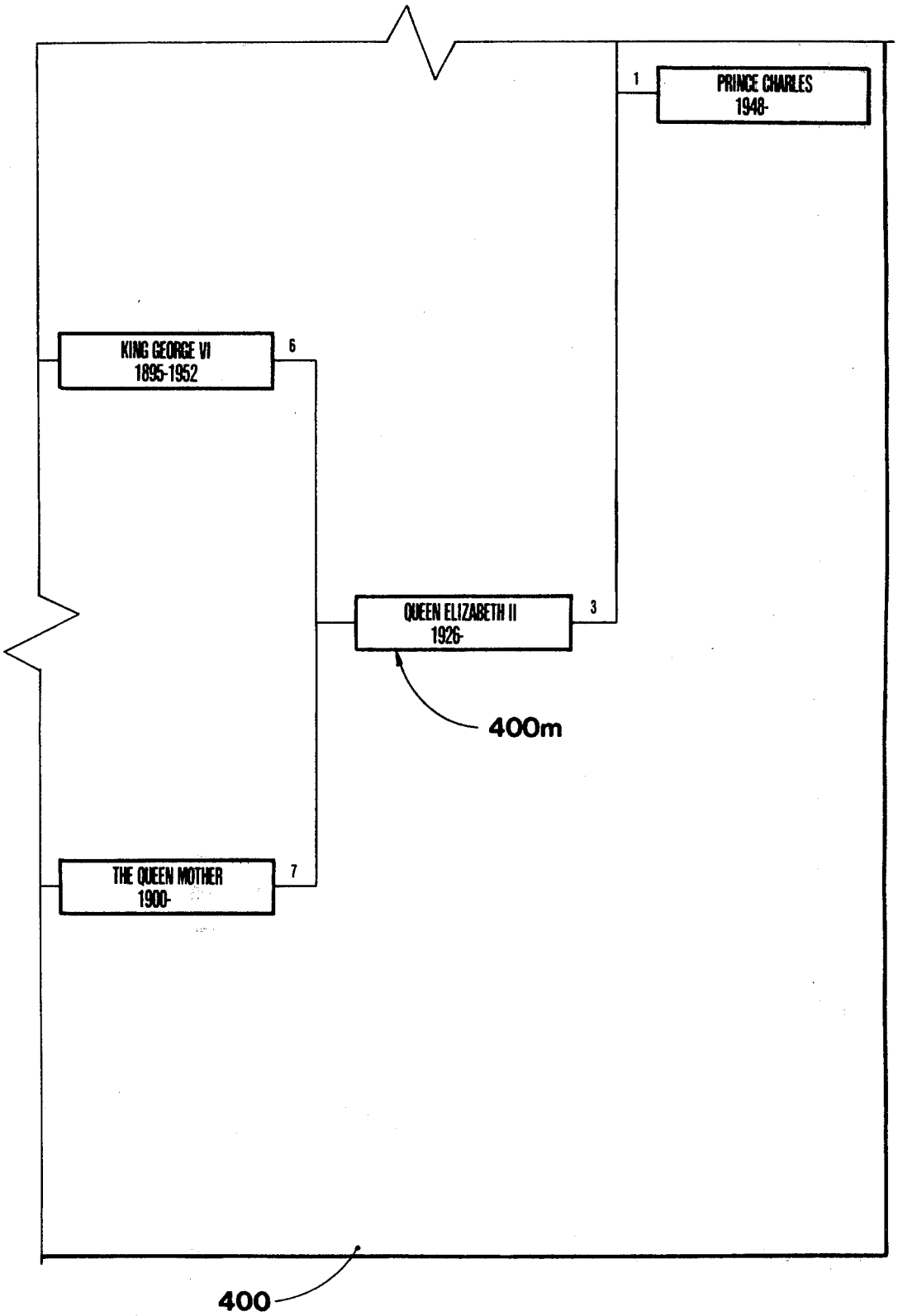
Figure 9C:
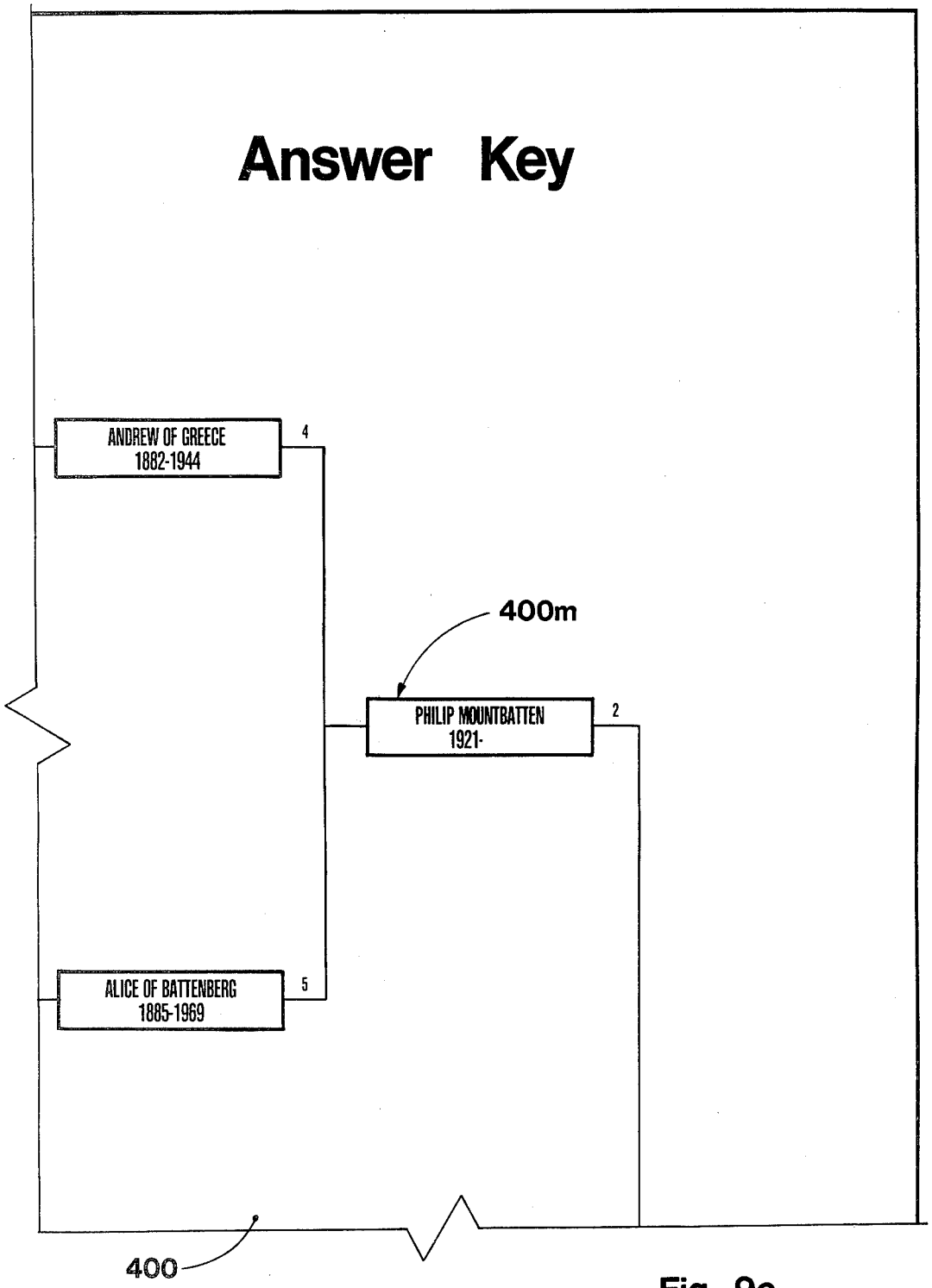
Figure 9D:
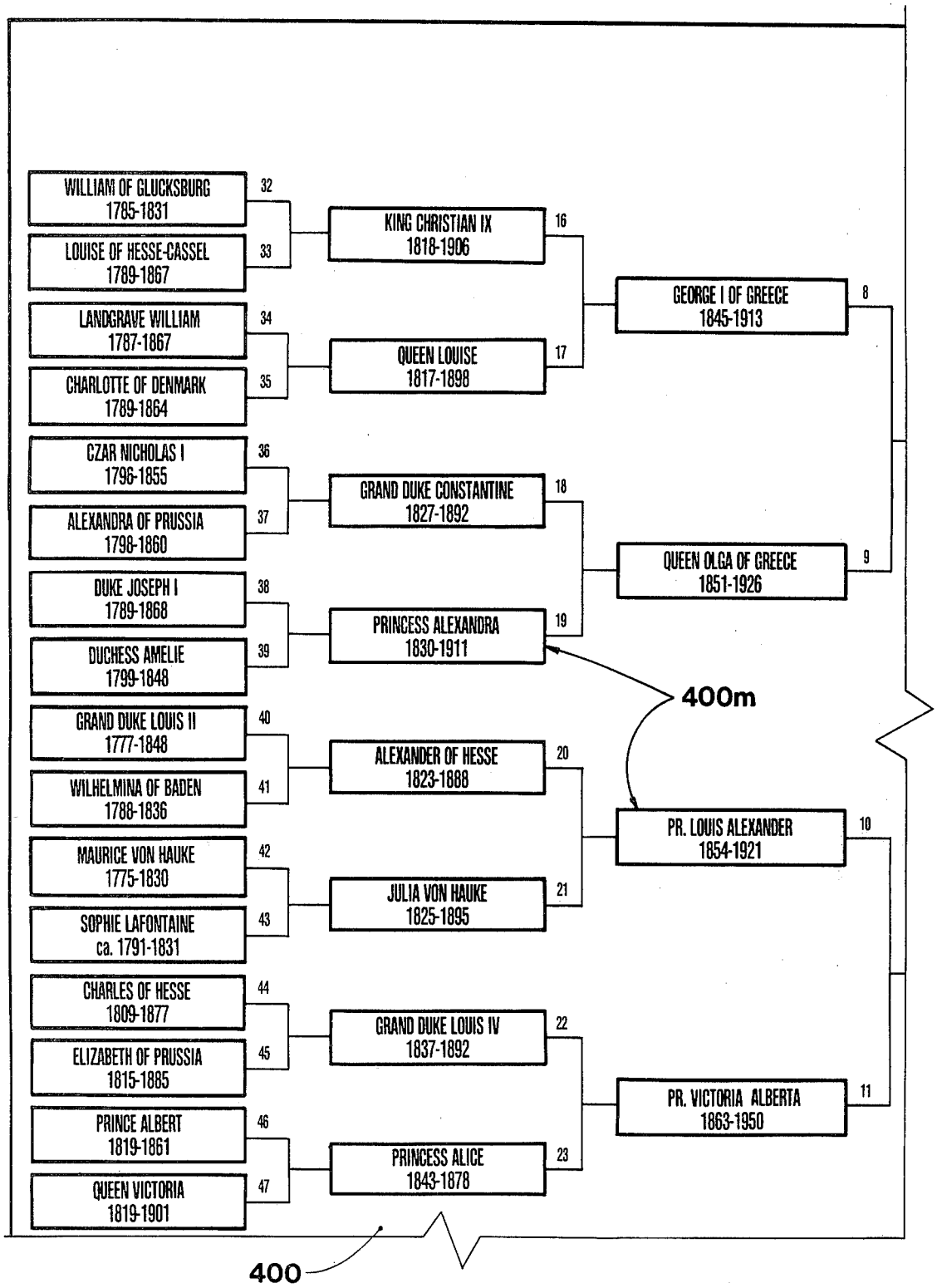

The exercise is finished when all users agree that the positions occupied by the sixty-three prisms (200) adequately reflect the familial information (200*f*) contained thereon. Numerical coding of ancestral sites (100*m*) is designed to facilitate verification of this collective judgement as placements are checked with an Answer Key (400; FIG. 9).

The answer key (400) has rectangular markings (400*m*) arranged in a fashion similar to those on the board or pedigree surface (100). Within each of these markings (400*m*) is the name and anniversary dates of one of the sixty-three individuals in the pedigree. The placement of names and dates is accomplished so that a one-to-one analogy can be drawn between the location of nominal information on the answer key (400) and the ancestral sites (100*m*) on the board (100).

The foregoing description of the preferred embodiment is for illustrative purposes only. The invention can be used to construct family trees of any person, or for that matter, any sexually reproduced being. For example, the principles applied in constructing the family tree of His Royal Highness, Charles Prince of Wales, could also be applied to other famous people, ficticious people, ordinary people and even to race horses, show dogs, or the like.

What we claim is:

1. A genealogy apparatus comprising:

a single panel, said panel including a substantially flat playing board with a unitary playing surface the playing surface consisting of a plurality of stations defined by rectangular recesses in the playing board wherein each rectangular recess has an area sufficiently large to accomodate word indicia; wherein some said stations have word indicia thereon, and wherein each station represents an individual, said stations being arranged in a plurality of columns wherein each column represents a generation and wherein each successive column has half the number of stations of the preceding column, the individual stations of each column being juxtaposed with a pair of stations in the preceding column so that the pairs of stations represent parents and the individual stations represent children and so that the stations converge in paternal and maternal stepped arrays to a principal station;

color coding associated with the stations wherein paternal stations have a different color from maternal stations and wherein one station of each pair is coded with one shade of the color to represent a male and the other station of each pair is coded with another shade of the color to represent a female; and three dimensional playing pieces which are triangular in cross-section and have three rectangular sides, wherein each of the sides has word indicia thereupon identifying the piece as representing an individual, the word indicia on some of the pieces corresponding to the word indicia on some of said stations; and one of the sides forms a bottom side corresponding in geometry and area to the geometry and area of the recesses, whereby the playing pieces are mounted on the surface and within the recesses and do not readily slide relative thereto.

2. The genealogy apparatus of claim 1 wherein the the two surfaces not received in the recesses project above the playing surface and wherein the indicia identifying the individual is recorded on the two surfaces and is easily visible by those using the apparatus while supplemental information ascribed to the individual is on the side corresponding in geometry and area to the recess.

3. The genealogy apparatus of claim 2 wherein the column with the most number of stations is divided into maternal and paternal sections wherein each station has adjoining recesses to form a single indentation with alternate color coding therein and wherein there is a projection at each station which registers with an indentation adjacent to the bottom surface the playing piece mounted therein.

4. The genealogy apparatus of claim 3 wherein the playing surface includes line means for connecting each station to the two preceding stations.

5. The genealogy apparatus of claim 1 wherein selected ones, but not all stations, have indicia thereon identifying that station with a particular individual and three-dimensional playing piece.

6. The genealogy apparatus of claims 1, 3, 4 or 5 wherein the playing surface is a rectangle having sides approximately thirty inches long.

7. The genealogy apparatus of claims 1, 3, 4 or 5 wherein the playing pieces are isosceles triangles with the exposed rectangular sides being approximately one inch by four inches.

8. The genealogy apparatus of claims 1, 3, 4 or 5 wherein the playing surface is a rectangle having sides approximately thirty inches long wherein the playing pieces are isosceles triangles with the exposed rectangular sides and bottom side being approximately one inch by four inches, and wherein the playing surface includes sixtythree stations.

9. The genealogy apparatus of claim 1 further including an answer key having rectangular markings arranged in a fashion similar to the stations of the playing surface wherein the markings are arranged to indicate the proper positioning of the playing pieces on the playing surface.

10. The genealogy apparatus of claim 9 wherein the rectangular markings on the answer key and the stations on the playing surface have numerical indicia associated therewith to facilitate correlation of the answer key and stations.

* * * * *